US006761043B1

(12) United States Patent
Reznikov et al.

(10) Patent No.: US 6,761,043 B1
(45) Date of Patent: Jul. 13, 2004

(54) APPARATUS FOR COOLING FOOD PRODUCTS

(76) Inventors: Lev Reznikov, 1510 Ocean Pkwy., Brooklyn, NY (US) 11230; Zachary Schulman, 30 Spring Meadow Rd., Mt. Kisco, NY (US) 10536

( * ) Notice: Subject to any disclaimer, the term of this patent is extended or adjusted under 35 U.S.C. 154(b) by 0 days.

(21) Appl. No.: 09/446,172

(22) PCT Filed: Jun. 16, 1997

(86) PCT No.: PCT/US97/13232

§ 371 (c)(1),
(2), (4) Date: Dec. 16, 1999

(87) PCT Pub. No.: WO98/58218

PCT Pub. Date: Dec. 23, 1998

(51) Int. Cl.[7] ..... F25B 3/00

(52) U.S. Cl. ..... 62/603; 62/388

(58) Field of Search ..... 62/603, 384, 388, 62/293

(56) References Cited

U.S. PATENT DOCUMENTS 5,271,233 A * 12/1993 Parker et al. ..... 62/384

* cited by examiner

*Primary Examiner*—William C. Doerrler

(57) ABSTRACT

In an apparatus for cooling food products in a container a device for supplying liquid carbon dioxide into the container and withdrawing from the container is movable between an inoperative position in which it is located outside said opening of the container and outside of the container and an operative position in which it is located inserted in the opening of the container.

37 Claims, 21 Drawing Sheets

APPARATUS FOR COOLING FOOD PRODUCTS

TECHNICAL FIELD

The present invention relates to an apparatus for cooling food products for example in rail cars, containers, vessels, trucks, etc.

BACKGROUND ART

It is well known to cool food products with carbon dioxide. In known methods and apparatuses liquid carbon dioxide is supplied into the interior of a container and discharged through a plurality of nozzles so that the liquid carbon dioxide is chilled and forms snow which covers food products accommodated in the container. While the existing methods and apparatuses perform their intended functions in satisfactory manner, it is always desirable to reduce liquid carbon dioxide consumption and to increase efficiency of the method and the system so as to either produce the same amount of snow with lower liquid carbon dioxide consumption, or with the same energy supply produce more snow.

DISCLOSURE OF THE INVENTION

Accordingly, it is an object of the present invention to provide an apparatus for cooling food products, which is a further improvement of the existing methods and apparatuses.

It is also an object of the present invention to provide such an apparatus which allow producing of cold by supplying liquid carbon dioxide from outside of a food container, in particular for example from outside terminals, into the food container which is not supplied with corresponding devices for producing carbon dioxide snow.

In keeping with these objects and with others which will become apparent hereinafter, one feature of the present invention resides, briefly stated in an apparatus for cool food products, which comprises means for supplying liquid carbon dioxide into the interior of the container and discharging liquid carbon dioxide in the interior so as to form carbon dioxide snow in the container with simultaneous generation of carbon dioxide vapors, and means for withdrawing the carbon dioxide vapors from the container and moving the withdrawn carbon dioxide vapors in the vicinity of the supplying means so that cold from the withdrawn carbon dioxide vapors is transmitted to liquid carbon dioxide supplied by the supplying means, the supplying means and the withdrawing means being located outside of the container.

In accordance with another feature an apparatus for cooling food products has a container for accommodating cooled products, means for supplying liquid carbon dioxide into the container, means for discharging liquid carbon dioxide in the container so as to produce carbon dioxide snow with simultaneous generation of carbon dioxide vapors, and means for moving carbon dioxide vapors in the vicinity of the supplying means so that cold of carbon dioxide is transferred to the supplied liquid carbon dioxide.

The energy consumption for producing of carbon dioxide snow to cool the products is reached and the quantity of the snow produced with the inventive solution is increased.

It is also an object of the present invention to provide an apparatus for cooling food products, which comprises a tubular pipe adapted to extend in an interior of the container so as to supply liquid carbon dioxide, and a plurality of nozzles arranged on the distributor pipe to discharge the liquid carbon dioxide from the distributor pipe, the nozzles being arranged so that jets of liquid carbon dioxide ejected by the nozzles extend substantially along a longitudinal of the distributor pipe and against one another to collide substantially between the nozzles.

It is a feature of the present invention to provide an apparatus for cooling food products in a container, which comprises means for supplying liquid carbon dioxide into a container, at least two nozzles connected with the supplying means and discharging liquid carbon dioxide in two jets directed toward one another so as to produce carbon dioxide snow, and means for adjusting the jets of the nozzles so as to provide a uniform distribution of carbon dioxide snow over a surface of the food products.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

Best Mode of Carrying out the Invention

Figure 1:
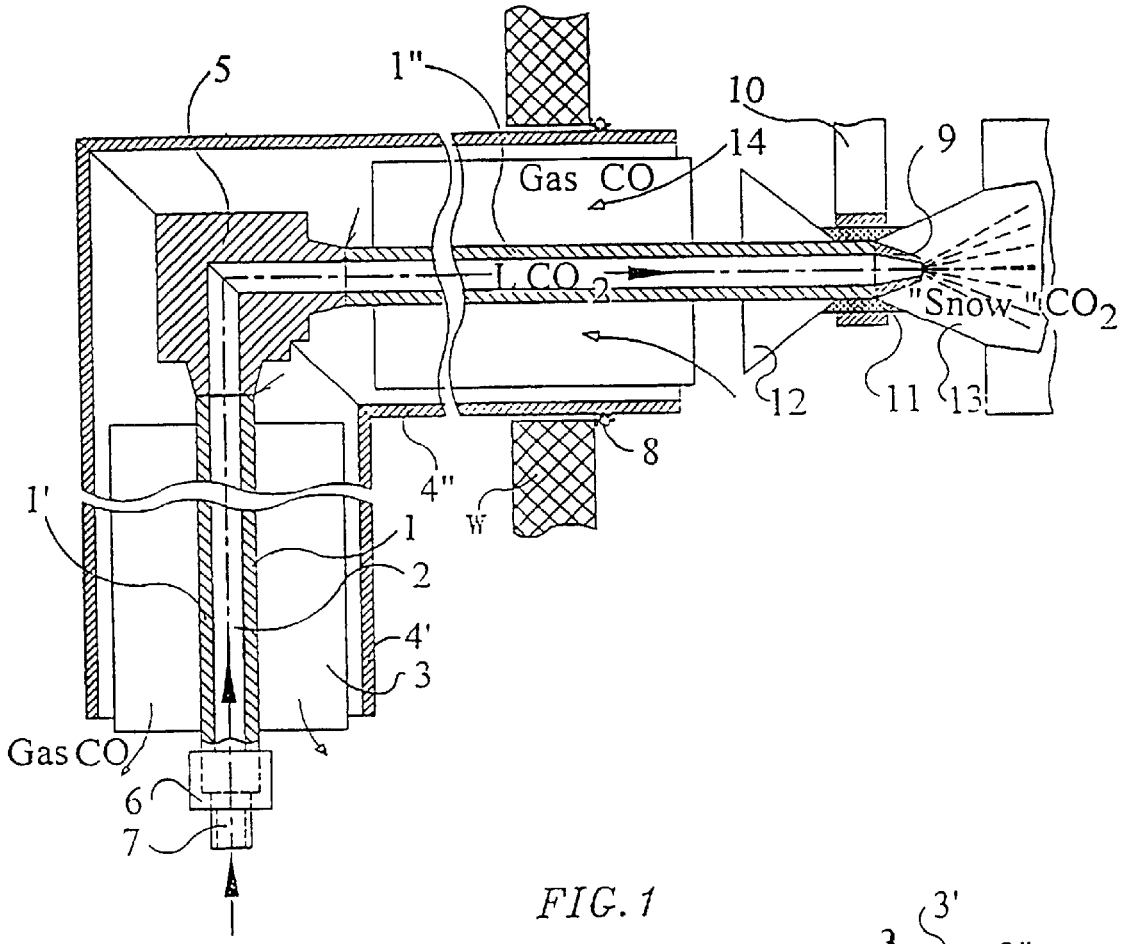
FIG. 1 is a view schematically showing an apparatus for cooling food products in accordance with the present invention.

An apparatus in accordance with the present invention shown in FIG. 1 is used for producing carbon dioxide snow in a container which is identified with reference C and has a wall W. The apparatus has an inner tube 1 provided with an inner passage 2 and a plurality of longitudinal fins 3. An outer tube 4 surrounds the inner tube 1 at a radial distance therefrom which can be defined by the fins 3 and forms an outer passage 5. The passage 2 of the inner tube 1 can be characterized as a high pressure passage while the passage 5 of the outer tube 4 can be characterized as a low pressure passage. Both tubes have two portions 1' and 1", and 4' and 4" which extend substantially perpendicularly relative to one another and are connected with one another by a connector 5. The lower end of the inner tube 1 in the drawing is connected through a connector 6 with a hose 7 extending from a supply tank for supplying liquid carbon dioxide. The horizontal portion 4" of the outer tube 4 extends through an inner opening of the wall W of the container C and can be sealed there by seals 8. The horizontal portion 1" of the inner tube 1 extends further into the interior of the container and is provided at its end with a nozzle 9. This end can be mounted in an opening of a mount 10 of the container with interposition of the sealing ring 11. A part of the portion 1" of the inner tube 1 can be provided with a guide cone 12. Finally, a horn 13 can extend from the right end of the inner tube portion 1" into a bunker 13.

In order to produce carbon dioxide snow in the container 1, the apparatus is inserted through the opening of the wall W of the container C as shown in the drawings, and liquid carbon dioxide is supplied through the interior of the inner tube 1. It is charged with throttling through the nozzle 9 and produced carbon dioxide snow in the interior of the container so as to cool food products accommodated in the container. During this process, carbon dioxide vapors are produced. As identified with arrows 14 carbon dioxide vapors move in the low pressure passage 5 between the outer tube 4 and the inner tube 1 under the action of high pressure during discharge of the liquid carbon dioxide through the nozzle. The carbon dioxide vapors move in counterflow relative to the flow of liquid carbon dioxide and, cold of carbon dioxide vapors is transferred through the inner tube 1 to the liquid carbon dioxide supplied through the passage 2 of the inner tube 1.

This process is facilitated by a plurality of fins provided on the inner tube 1.

Figure 2:
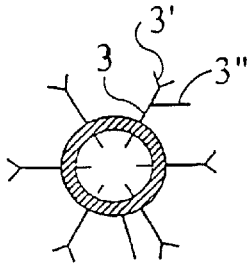
FIG. 2 is a view schematically showing a section of an element which is used for transferring of cold of carbon dioxide vapors to liquid carbon dioxide.

The inner tube 1 with the fins 3 can be formed as an extruded aluminum structure. As shown in FIG. 2, the fins can be formed by a plurality of elements 3' arranged in a star-like manner around the inner tube 1 and provided with a plurality of branches 3" so as to increase the heat transfer surface between carbon dioxide vapors and the fins.

Figure 3A:
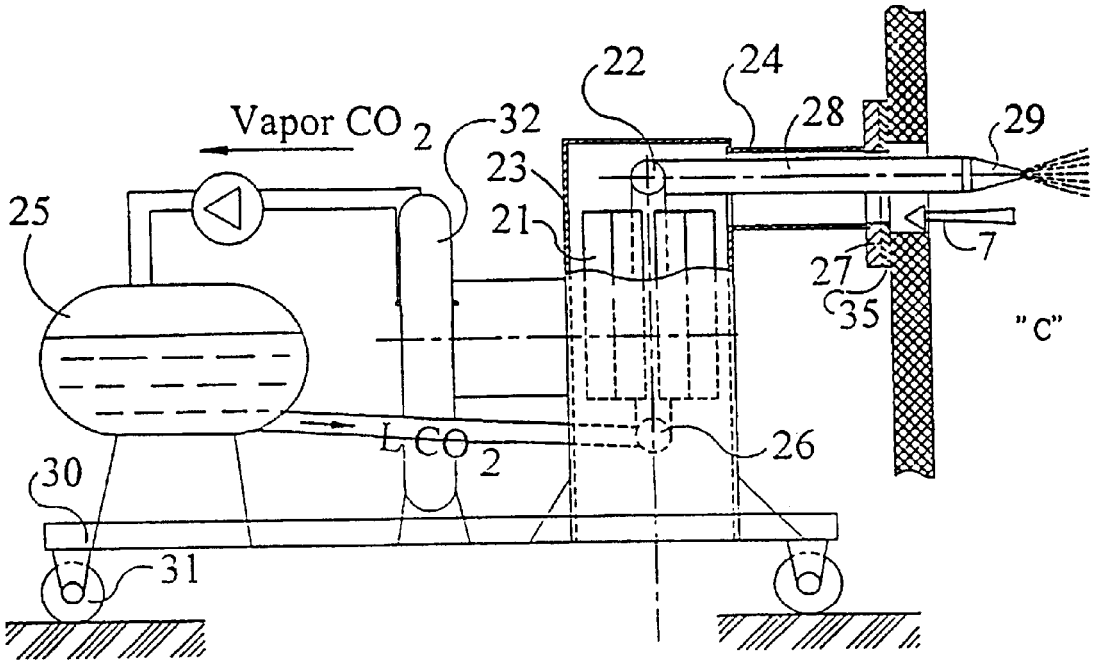
FIGS. 3*a* and 3*b* are a side view and a plan view of an apparatus in accordance with a further embodiment of the present invention.
Figure 3B:
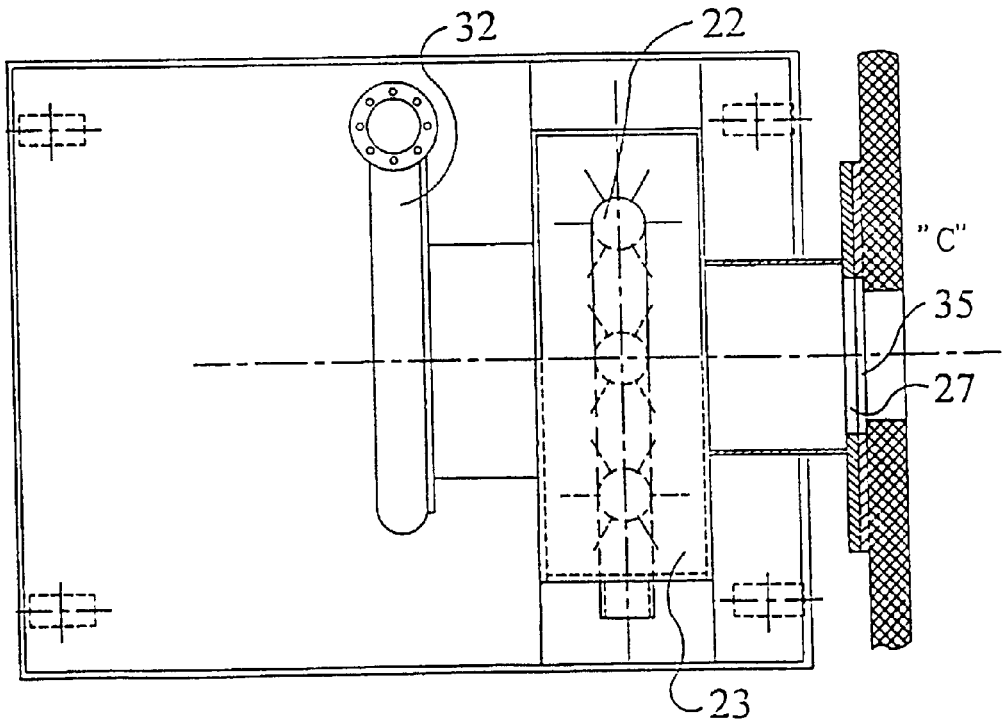

An apparatus shown in FIGS. 3*a* and 3*b*, includes a plurality of extrusion aluminum tubes 21 provided with a plurality of fins and extending between two collectors 22 and 26. The package of the tubes is accommodated in a casing 23. An outer tube 24 is connectable by a flange 27 with a wall W of a container C. The upper collector 22 is connected with a pipe 28 provided with a nozzle 29 on its end. The apparatus further has a supporting frame 30 provided with a plurality of wheels 31. A fan 32 communicates with the interior of the casing 23. Liquid carbon dioxide is supplied from a tank 25 into a lower collector 26 and then through the pipes 21, the upper collector 22, the nozzle 29 into the container C.

It is believed that the operation of the apparatus of FIGS. 3*a* and 3*b* is self-explanatory. The apparatus is moved toward the container 1 and its flange 27 is connected with the container C or more particularly with its outer flange 35 for example by bolts. Liquid carbon dioxide is discharged through the nozzle 29 into the interior of the container so as to form carbon dioxide flow for cooling the food products. Carbon dioxide vapors move from the container into the interior of the outer pipe 24 under the action of the suction of the fan 32 and pass between the aluminum tubes 21 and their fins so that cold of carbon dioxide vapors is transferred to liquid carbon dioxide. Then the vapors can be liquefied and supplied through a passage 23 further into the tank 25. The fan 23 can be used for intensification of movement of carbon dioxide vapors from the container with low excessive pressure inside.

Figure 3C:
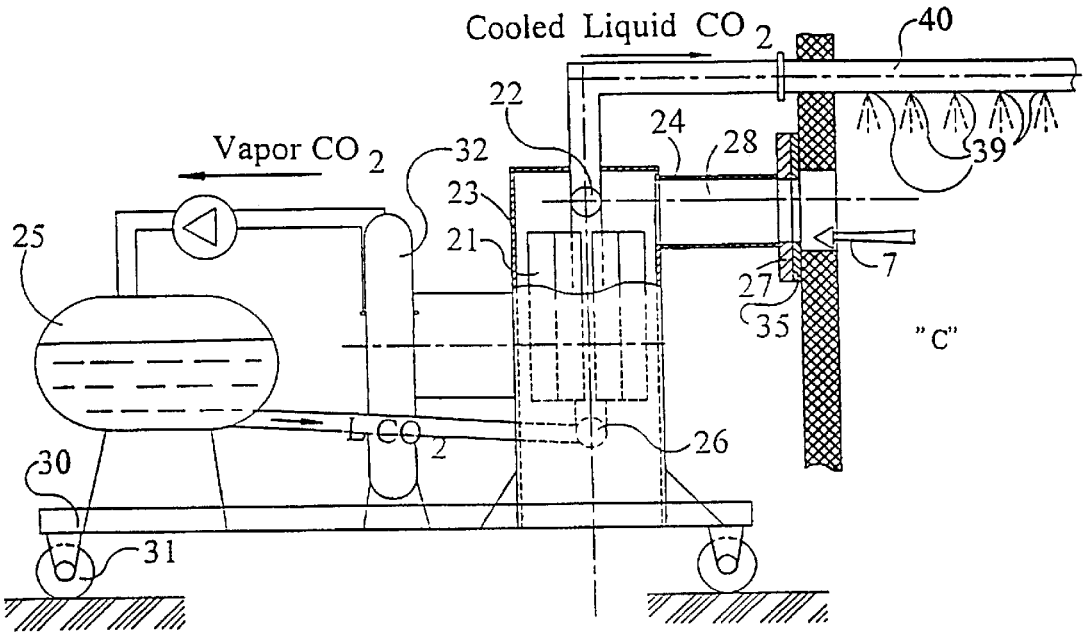

As shown in FIG. 3*c*, nozzles 39 can be arranged on a dispenser 40 located inside the container C. In this case the pipe is releasably connected with the dispenser 40.

Figure 4A:
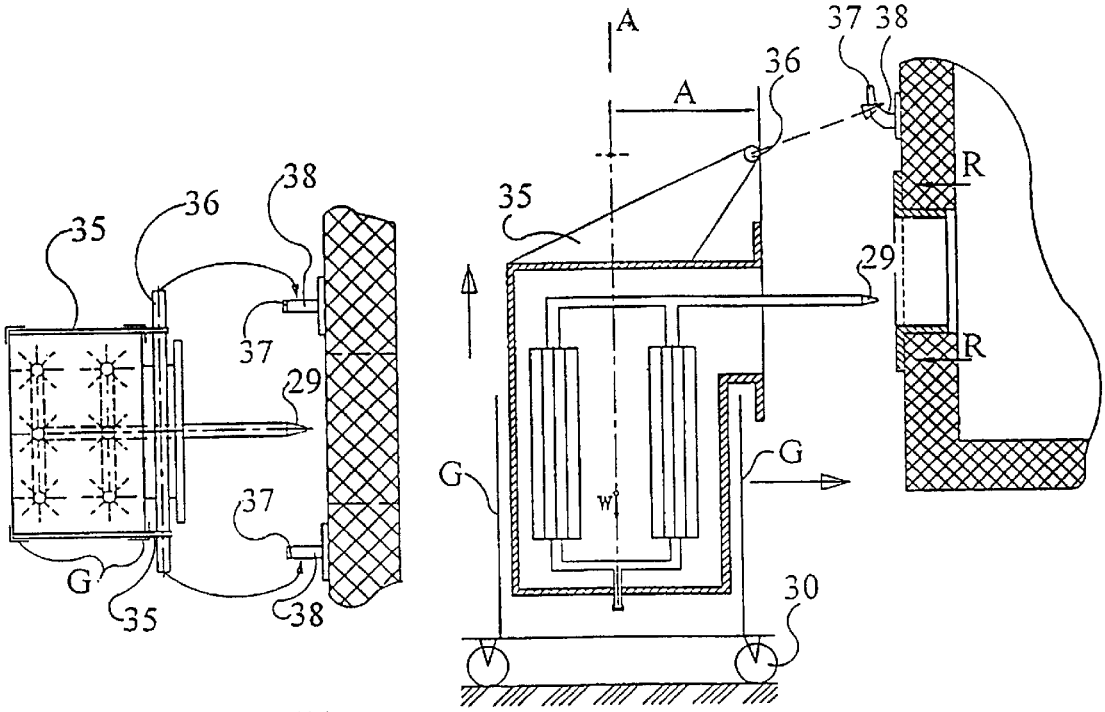
FIGS. 4*a* and 4*b* are views showing connection of the apparatus in accordance with the present invention with a container for storing food products.
Figure 4B:
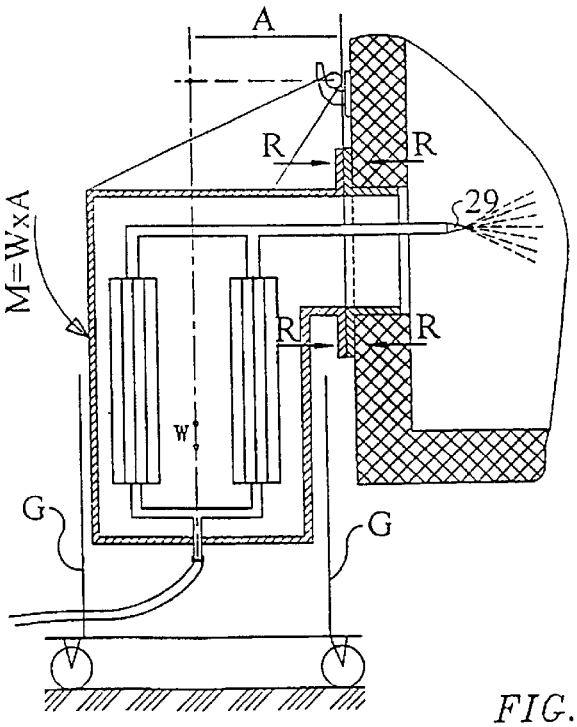

As can be seen from FIGS. 4*a* and 4*b*, the apparatus can be provided with arms 35 having lateral cross rods 36 which connect the free ends of the arms, while matching arm brackets 37 with slots 38 can be provided on upper edges of the arms mounted on the container above its opening. For installation, the heat exchanger block is displaced upwardly in guides G of the frame 30, then the apparatus is moved toward the container C until the cross rod 36 is positioned about the slot 38, and the block B is lowered to pivotally engage the rod 36 into the slot 38. The thusly suspended system can turn under the action of its weight around the rod, and the flange of the system is tightly pressed against the flange of the container.

Figure 5:
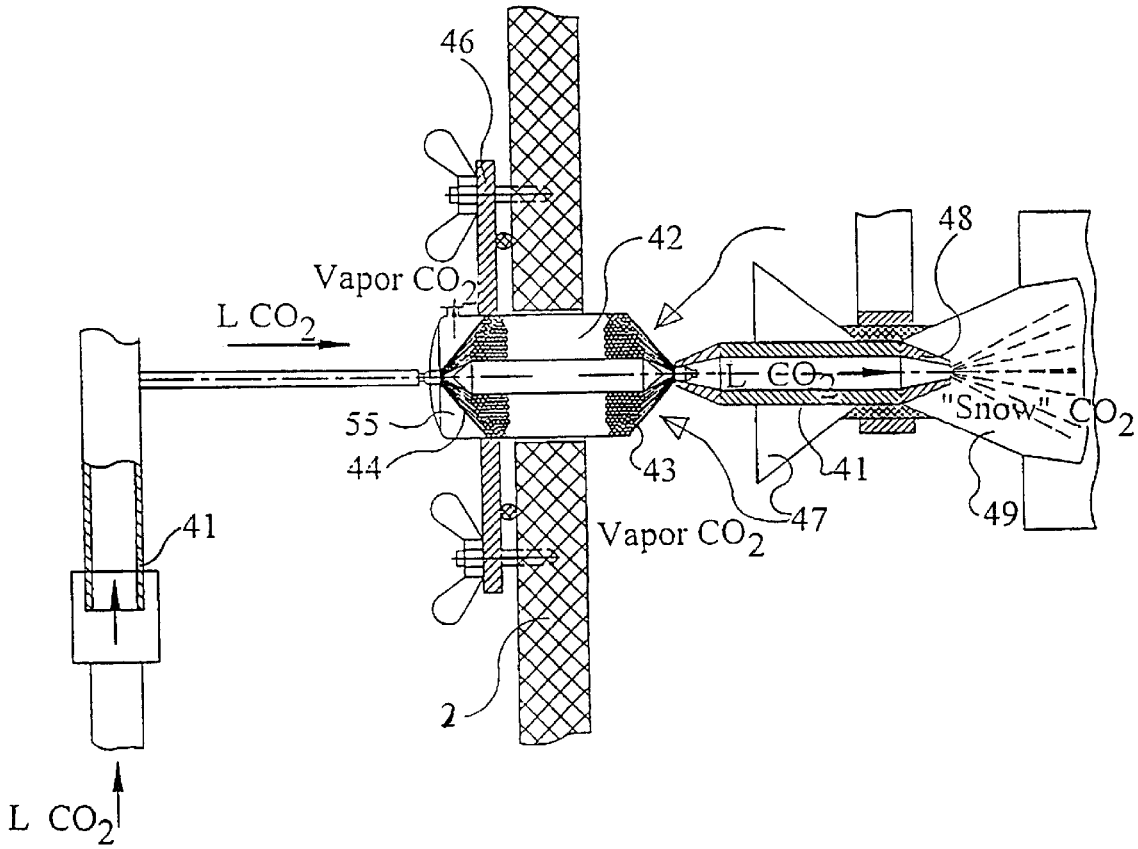
FIG. 5 is a view showing a further modification of the apparatus in accordance with the present invention.

In the embodiment shown in FIG. 5 a tube 41 for supplying liquid carbon dioxide extends through a heat exchanging element 42 provided with a plurality of coiled tubes 43 with fins spaced from one another by spaces 44. A low pressure channel 55 is formed between an outer casing and the coil tubes. The element 42, 43, 44 is mounted in an inner opening of the wall 2 of the container 1 by a mounting flange 46. The apparatus is provided with a guide cone 47. A nozzle 48 is arranged on the end of the tube 41 and associated with a horn 49. The nozzle is fixed inside the horn while the element 42, 43, 44 provides for a possibility to adjust the position of the nozzle 48 before supplying a liquid carbon dioxide, or to change the position during the supply to provide uniform distribution of carbon dioxide snow in the container, because the element 42, 43, 44 is arranged movably in its axial direction in the opening of the wall 2 of the container.

Figure 6A:
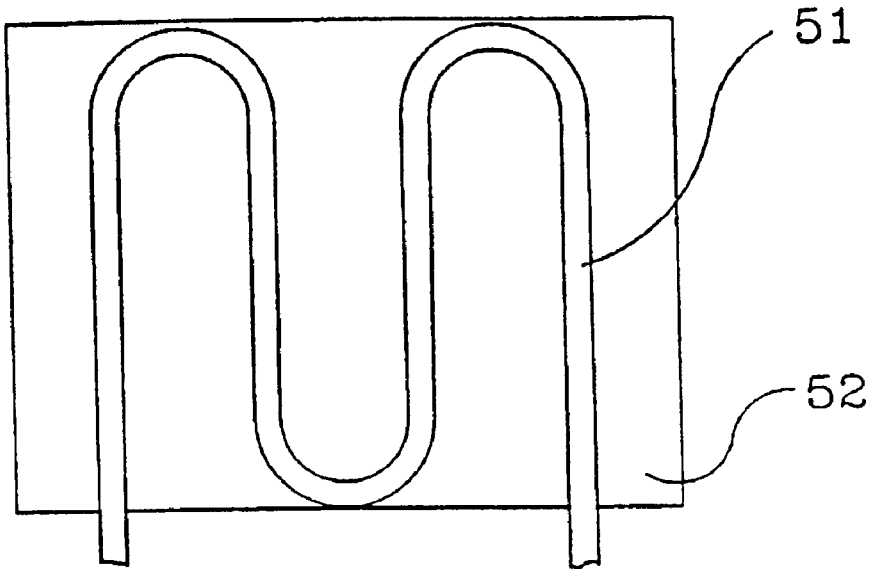
FIGS. 6*a* and 6*b* are a front view and a side view of a heat exchanging element of the inventive apparatus.
Figure 6B:
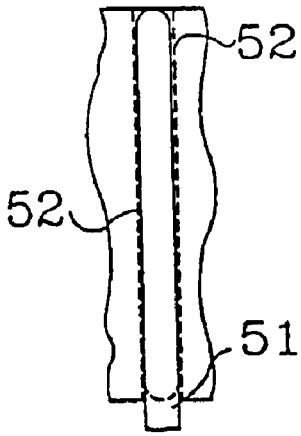

In accordance with a further feature of the inventive apparatus, snow flakes produced during the operation are filtered from carbon dioxide vapors which are utilized for additional cooling of the supplied carbon dioxide. As shown in FIGS. 6*a*, 6*b* the heat exchanging element shown here has a pipe 51 for supplying liquid carbon dioxide, which is finned with a metal wire net or mesh 52. In installed position, the net or mesh 52 is arranged transverse to the flow of carbon dioxide vapors. The net or mesh 52 is formed so that it is permeable for carbon dioxide vapors, but snow flakes of carbon dioxide are retained and precipitate on the net or mesh. Such a heat exchanging element can be installed for example in the inlet opening 13 of the container so that the net or mesh 52 overlaps the inlet opening. After the precipitation the snow flakes are sublimated, returning the refrigeration to liquid carbon dioxide through the high heat conductive mesh 52, so that the mesh simultaneously performs the double function of being a filter element and an efficient heat exchanger.

Figure 7A:
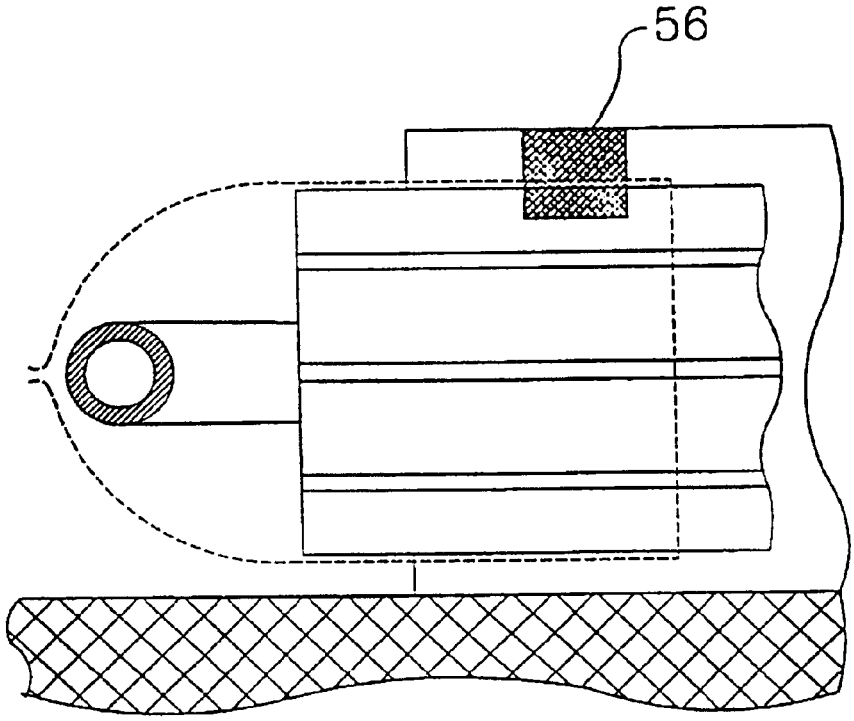
FIGS. 7*a* and 7*b* are a side view and a front view of the heat exchanging element of the inventive apparatus in accordance with a further embodiment of the invention.
Figure 7B:
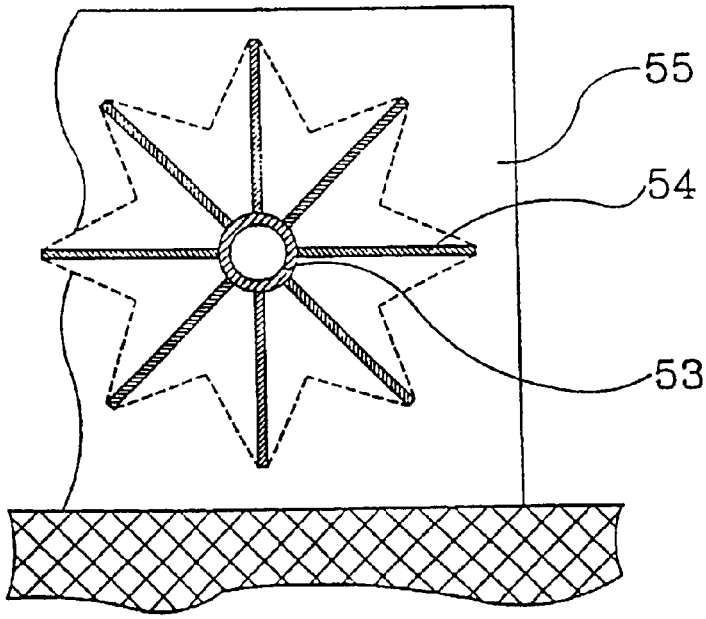

In accordance with another embodiment shown in FIGS. 7*a*, 7*b* the heat exchanging element has a pipe 53 with a plurality of longitudinally extending fins 54 arranged in a star-like manner. It is arranged in a casing 55. Wire nets are soldered or welded to support edges of the fins 54 to provide a reliable mechanical connection and a low contact thermal resistance of the connection between the supporting elements and main filtering elements. The heat exchanging element can also be provided with an elastic sealant 56 of the vapor flow.

Figure 8:
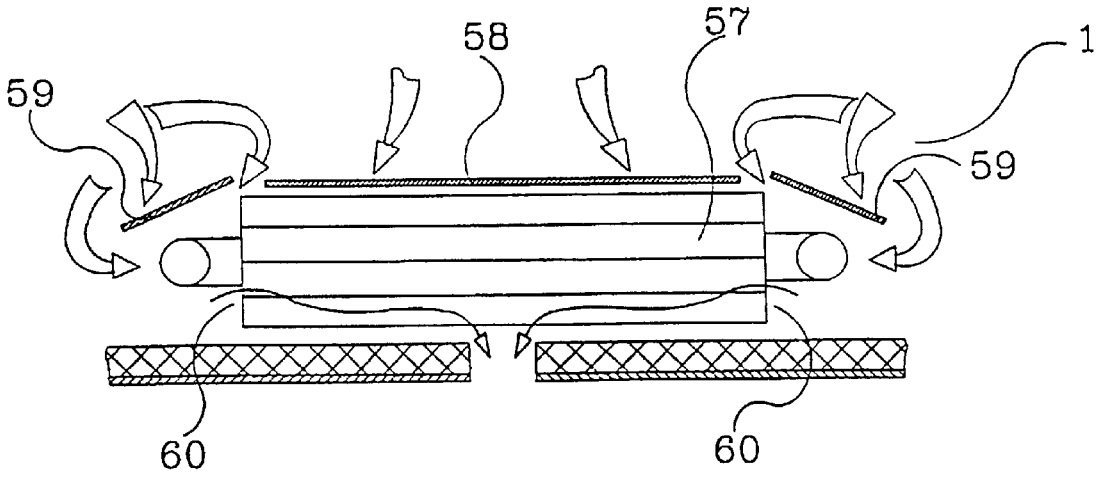
FIG. 8 is a view showing a still further modification of the heat exchanging element of the inventive apparatus.

FIG. 8 shows another heat exchanging element with separation of snow flakes from the vapor stream. Heat exchanging elements 57 are arranged in a casing 58 which is open at both ends to the vapor flow. Screens-deflectors 59 of the vapor flow are installed on the opening 60 in the casing 58 to separate parts of dry ice which move with a high speed with the vapor stream, carrying out the snow flakes. Sharp change of the direction of stream speed vector provides effective separation of solid particles having high density from the stream. The best effect is obtained when the screens are arranged under angles 20°–60° to the main direction of the stream inside or outside of the container.

Figure 9:
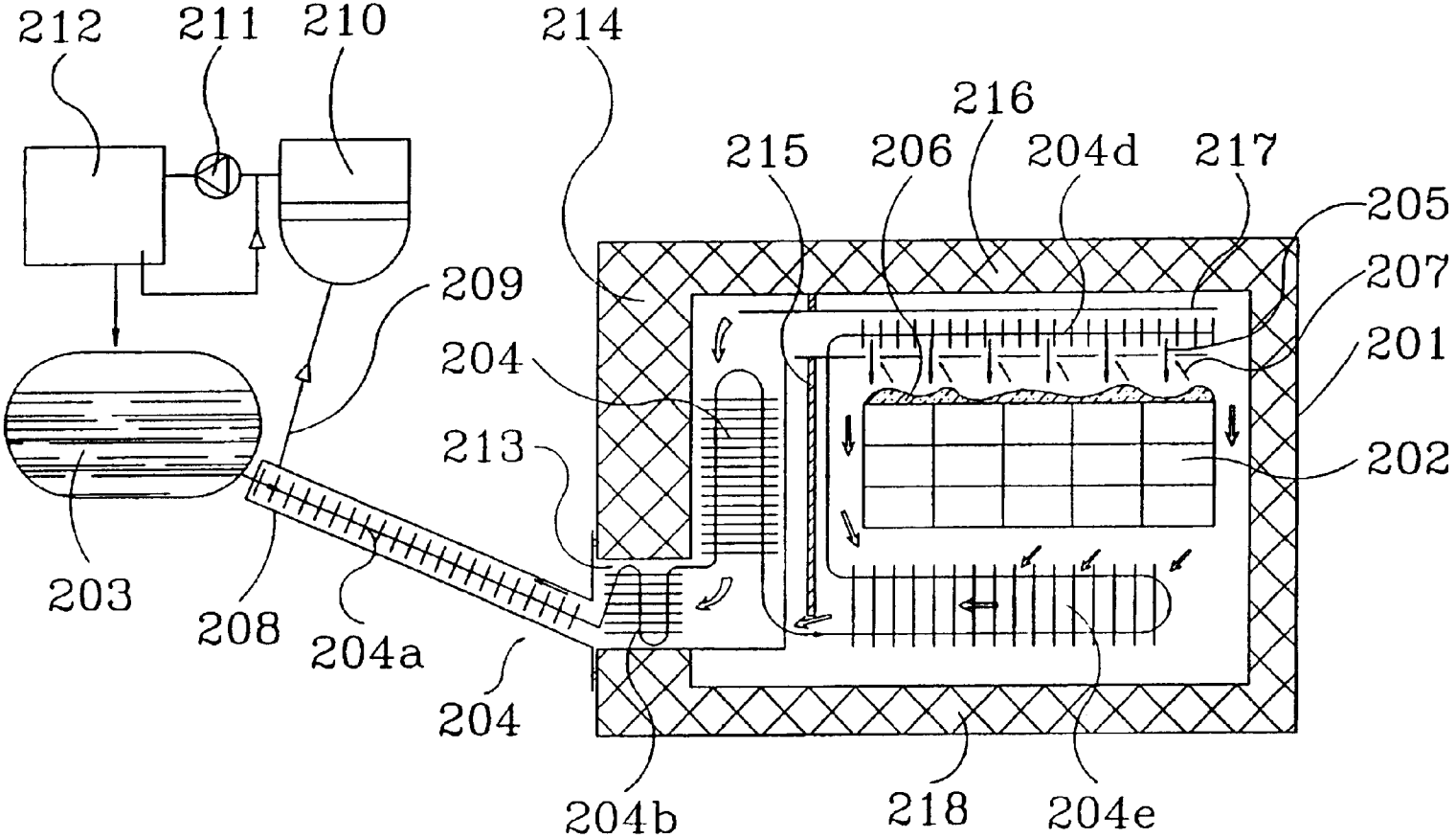
FIG. 9 is a schematic view showing another apparatus for cooling food products.

An apparatus shown in FIG. 9 in accordance with the present invention has a heat insulated storage container which is identified with reference numeral 101 and utilized for storing food products 102 in a refrigerated condition for stationary storage or for transportation. The apparatus has an isothermal tank 103 with liquid carbon dioxide. The liquid carbon dioxide is supplied through a meandering line 104 into the inner space of the container 101 and discharged into the interior of the container through a plurality of nozzles 105 so as to form carbon dioxide snow 106 which covers the food product 102 and to keep it refrigerated. At the same time, carbon dioxide vapors are formed in the interior of the container 101.

In accordance with the present invention, the carbon dioxide vapors identified with reference numeral 107 are directed so as to bring them into contact with the supply line 104 for supplying liquid carbon dioxide so that the cold of the carbon dioxide vapors is utilized for cooling the liquid carbon dioxide.

FIG. 9 shows several embodiments of an element which provides the utilization of cold of evacuating carbon dioxide vapors for overcooling of the supplied liquid carbon dioxide. One of such elements is arranged in the region between the tank 103 and the inner opening of the container 101. It has an outer tube 108, and a portion 104*a* of the liquid carbon dioxide supply line located in the outer tube 108 and preferably provided with a plurality of ribs. The liquid carbon dioxide is supplied from a tank 101 toward the container in the interior of the portion 104*a* of the supply line 104, while carbon dioxide vapors are supplied in an opposite direction from the container 101 inside the pipe 108 over the portion 104*a* of the liquid carbon dioxide supply line. Then the carbon dioxide vapors are withdrawn through a line 109 into a gas vessel 110 and supplied by a compressor 111 into a liquefying vessel 112 in which they are liquefied and the liquid carbon dioxide is supplied to the tank 103.

Another heat exchanging element is formed in an inlet opening of the container 101. In particular, a finned portion 104*b* of the liquid carbon dioxide supply line 104 is located inside the inlet opening 113 and supplies the liquid carbon dioxide into the container while the carbon dioxide vapors 107 pass in an opposite direction between an inner wall of the inlet opening 113 and the outer surface of the portion 4*b* to thereafter flow into the pipe 108 again. A further heat exchanging element is formed in a space between a side wall 114 of the container 101 and a partition 115 of the inner space of the container. Liquid carbon dioxide passes through a finned portion 104*c* of the liquid carbon dioxide supply line 104, while carbon dioxide vapors flow in the space between the portion 104*b* on the one hand, and the side wall 114 and the partition 115 of the container 101 on the other hand, to further flow through the opening 113 into the pipe 108.

Still another heat exchanging element is formed in the area which is close to a ceiling 116 of the container 101. Liquid carbon dioxide flows through a portion 104*d* of the liquid carbon dioxide supply line 4 while carbon dioxide vapors 107 flow into a pipe 117 which surrounds the portion 104*d* and further through the pipe 117 in the opposite direction. Finally, the heat exchanging element can be also located in the area of a floor 117 of the container 101. Here again the liquid carbon dioxide flows through a portion 104*e* of the liquid carbon dioxide supply line 104 while the carbon dioxide vapors flow around the portion 104*a* in an opposite direction in the region of the floor 117, preferably through beams arranged on the floor. It is to be understood that in all embodiment of the heat exchanging elements which include the portions 104*a*, 104*b*, 104*c*, 104*d*, 104*e* of the liquid carbon dioxide supply line, the carbon dioxide vapors are preferably evacuated from the container 101 and then liquefied so that the liquid carbon dioxide is supplied again into the tank 103. It is also to be understood that it is not to necessary to provide the heat exchanging elements associated with all portions 104*a*, 104*b*, 104*c*, 104*d*, 104*e*. It is possible to provide in the inventive apparatus only one or more heat exchanging elements from those shown in the drawings and described hereinabove. Movement of the carbon dioxide vapor flow is provided due to pressure difference generated inside the container 1 during conversion of the liquid carbon dioxide due to its throttling with high pressure inside the container. The flow of the carbon dioxide vapors also carries snow flakes which additionally cool the supplied liquid carbon dioxide.

Figure 10:
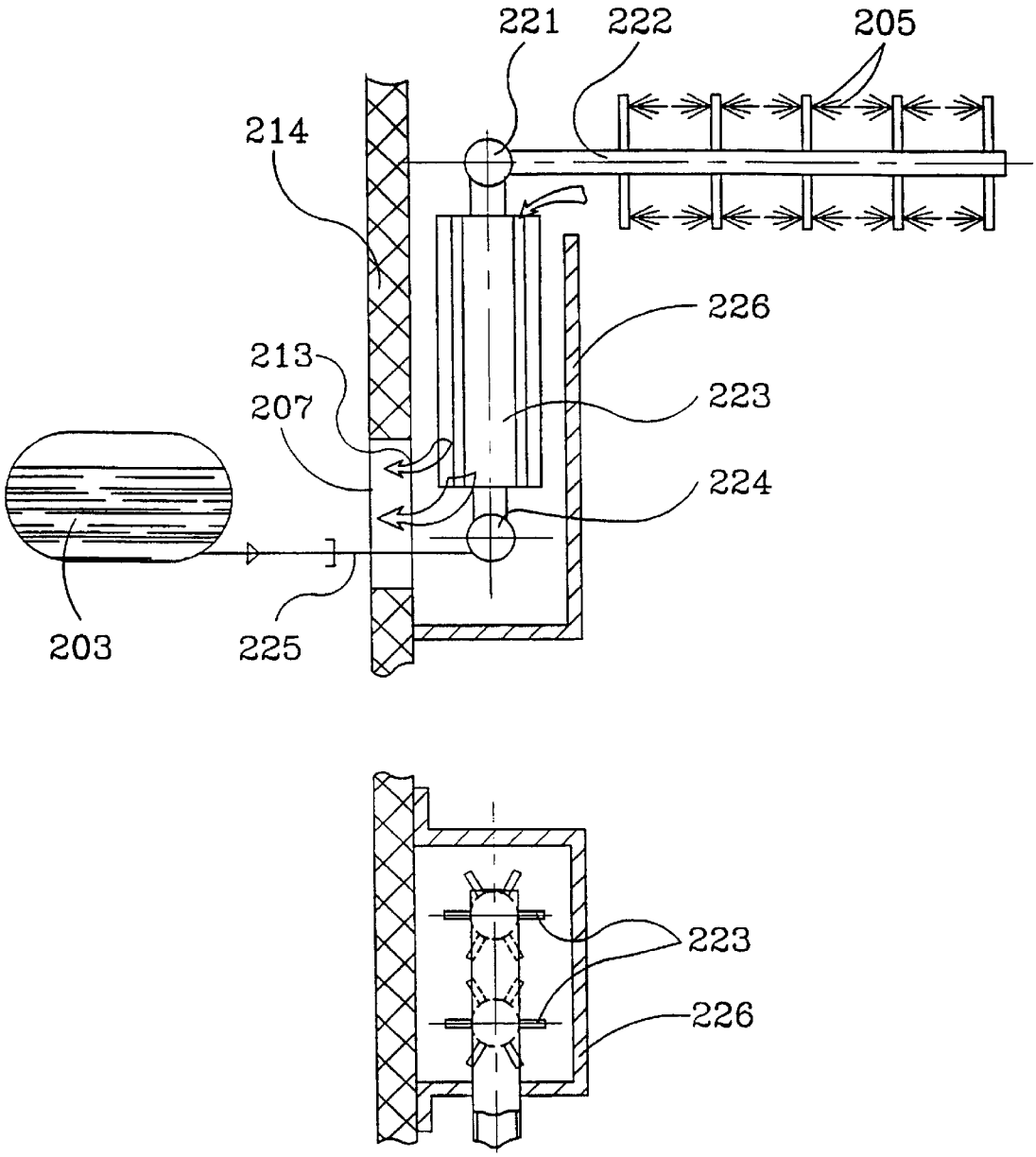
FIG. 10 is a view showing an element in which cold of carbon dioxide vapors produced during formation of snow is utilized for cooling the supply of the liquid carbon dioxide, in accordance with the present invention.

FIG. 10 shows one of the heat exchanging elements in accordance with the present invention. It has an upper collector 121 connected with a dispensing portion 122 of the liquid carbon dioxide supply line provided with a plurality of nozzles. A plurality of extruded ribbed tubes 123 connect the upper collector 121 with the lower connector 122, which in turn is connected with an inlet portion 125 of liquid carbon dioxide supply line 104. A casing 126 surrounds the extrusion pipes 123 and is mounted on the wall 1143 of the container 102. The upper end of the casing 126 is open into the interior of the container 101, while the lower end of the casing is open into the inlet opening 113 of the container. The carbon dioxide vapors flow through the inner space of the casing to cool the supplied liquid carbon dioxide and then leave the container through the opening 113. The carbon dioxide vapors and the liquid carbon dioxide moving in opposite directions provide for conditions for efficient cooling of liquid carbon dioxide by carbon dioxide vapors.

Figure 11:
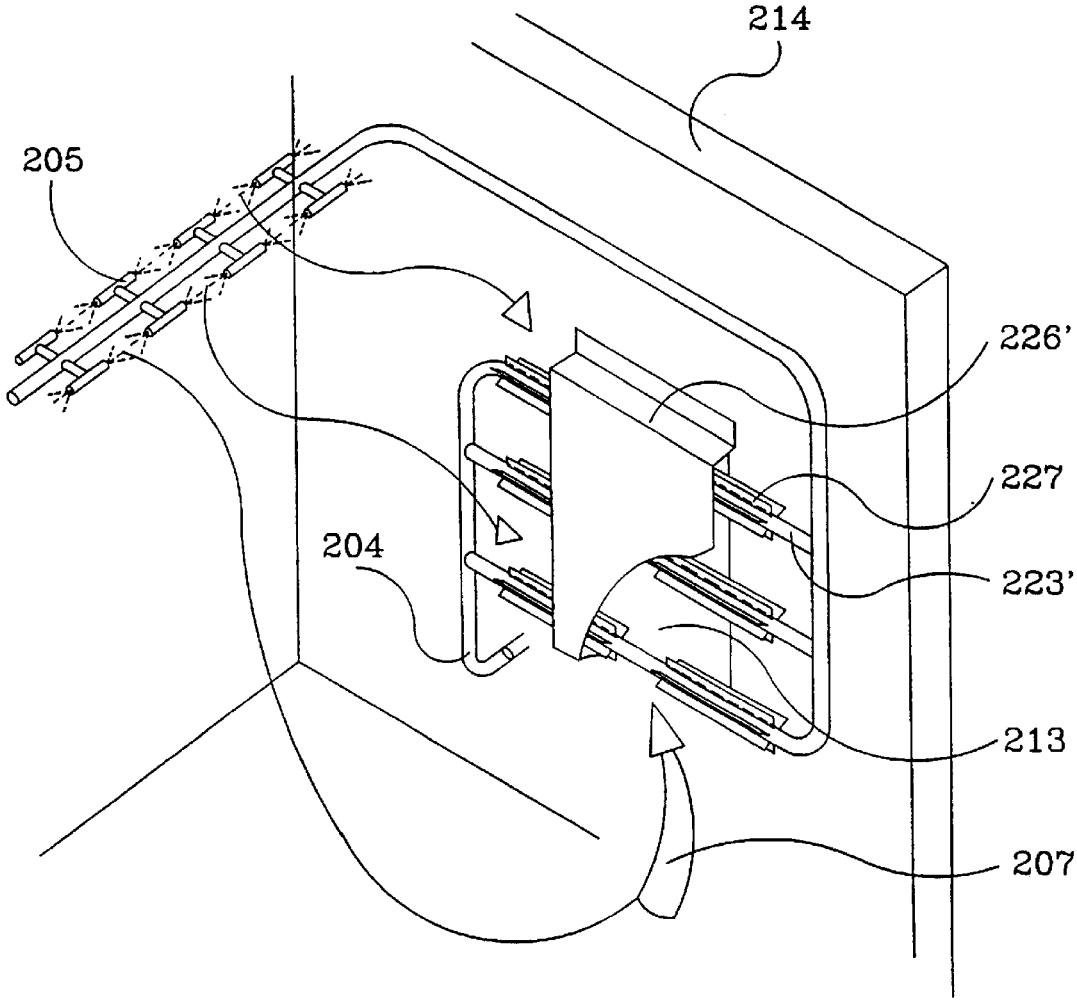
FIG. 11 is a view showing a further modification of the element of FIG. 10.

In the embodiment of FIG. 11 in contrast to the embodiment of FIG. 10, the casing 126' is connected with the opening 13 in the wall 14 of the container 101 through a middle part. Both ends of the casing 126' are open into the interior of the container 101. Fins 127 of the extrusion pipes 123' can be interrupted in the area of their connection to the opening 113 for improved distribution vapor flow in this embodiment enters the heat exchanging element through both ends of the casing 126', and corresponding halves of the full flow move toward each other to the center of the element, and after uniting in the center leave through the opening 113 again with a full flow rate. Such a path provides the lowest hydraulic pressure resistance to the vapor flow, and therefore the lowest level of redundant pressure in the space of the container 101 during charging, Another advantage of this embodiment is that the opposite direction of speed vectors of the vapor flow halves in the heat exchanging element helps to separate the snow flakes from the vapor flow due to sharp changes of the speed so that precipitation is facilitated after colliding of the vapor streams.

Figure 12A:
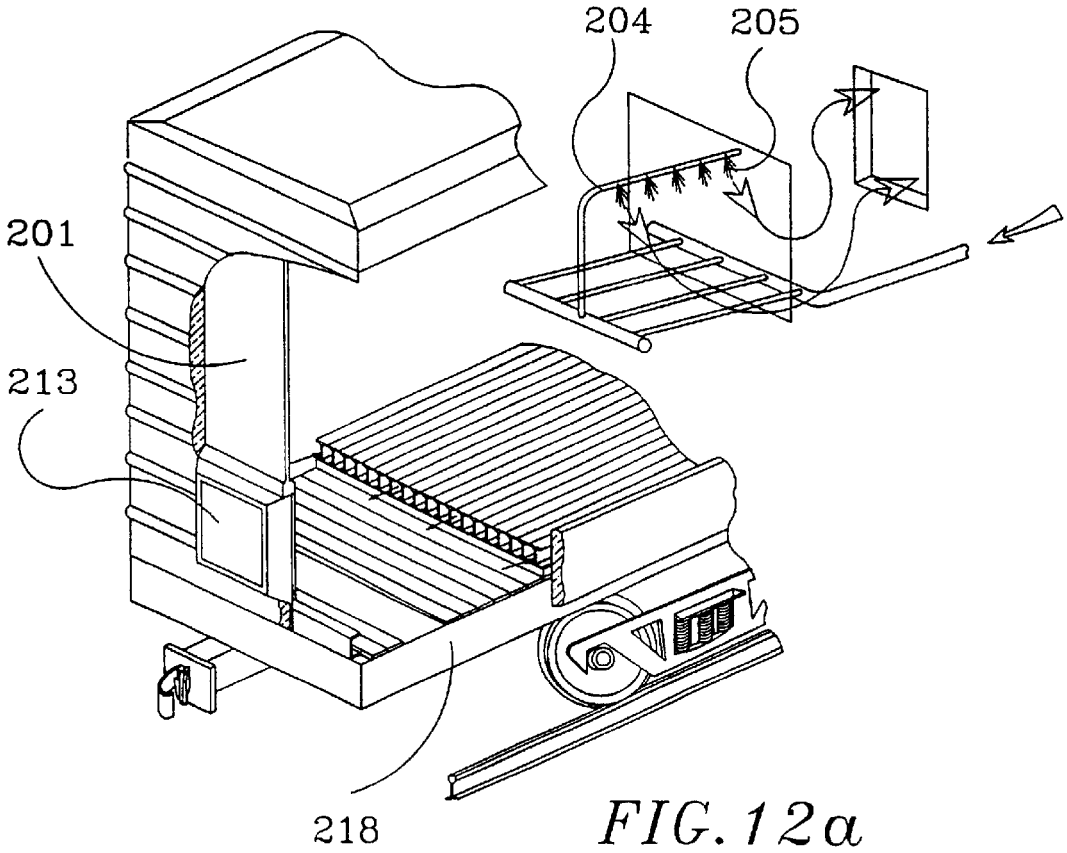
FIGS. 12*a* and 12*b* are perspective views of a container with the above mentioned element and the element itself in accordance with a further modification of the present invention.
Figure 12B:
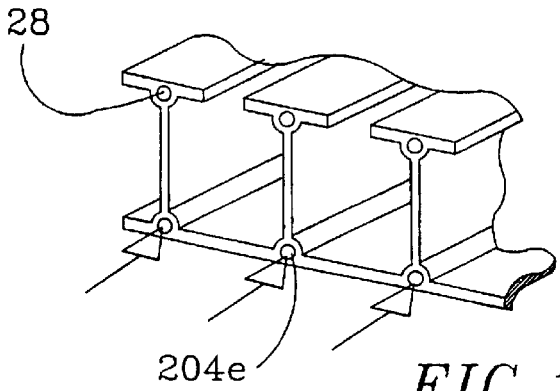

FIGS. 12*a* and 12*b* show a food container with the floor 18 provided with a plurality of extruded T-beam elements. As can be seen fro the drawings, the T-beams are provided with a plurality of passages 128 which form a portion 104*e* of the liquid carbon dioxide supply line. Liquid carbon dioxide is supplied through the passages 128 at high pressure. It is not to be understood that liquid carbon dioxide is supplied into the passages 128 from another portion of the liquid carbon dioxide supply line 104. Carbon dioxide vapors flow between the T beams in an opposite direction so as to provide additional cooling of the liquid carbon dioxide. In this embodiment the cold of the carbon dioxide vapors is utilized for cooling the liquid carbon dioxide by means of the T-beam shaped floor which operates a heat exchanger.

Figure 13A:
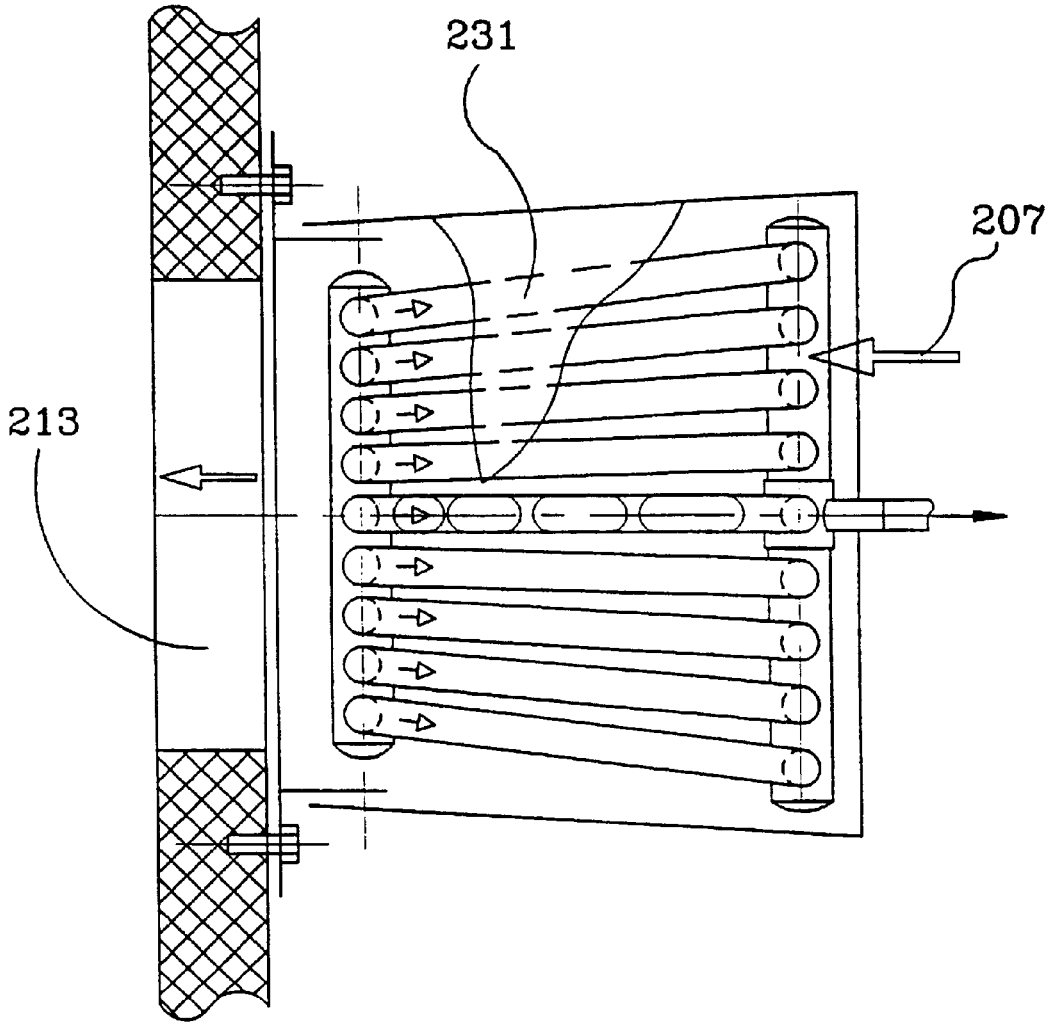
FIGS. 13*a* and 13*b* are views showing a heat exchange element.
Figure 13B:
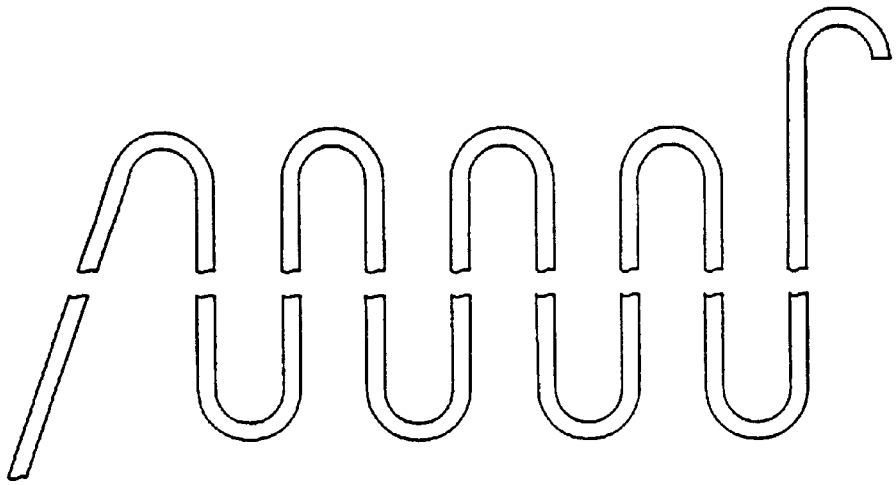

FIGS. 13*a* and 13*b* show a further modification of a heat exchanging element with which the supplied liquid carbon dioxide is cooled by carbon dioxide vapors. The heat exchanging element has bent plain or finned tubes 131 which form flat coil panels 132, which are connected with collectors 133 and 134. The collector 133 is arranged near the opening 113 of the container 101. The package of the coils-panels is placed in a casing 135. The coils are connected to the collectors at different distances. Therefore the distance between the panels increases from the opening in the wall toward a free section which is open into the interior of the container. The cross-section of the vapor flow reduces while moving from the container between the coil panels toward the opening, and at the same time the speed and heat transfer intensity increases. Such a design of the heat exchanging element and flow speed provides the maximum efficiency of the heat transfer with the lowest specific hydraulic resistance to the vapor flow. In the shown embodiment reference numeral 136 identifies a feeding pipe, reference numeral 137 identifies a pipe connector to a dispensing pipe with nozzles and reference numeral 138 identifies a frame of the package of coils.

Figure 14A:
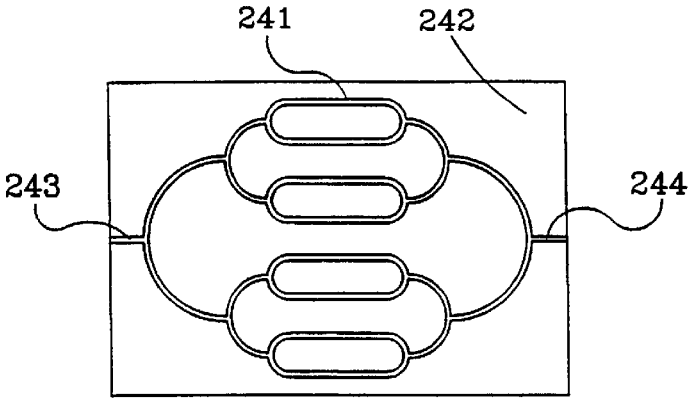
FIGS. 14*a*, 14*b*, and 14*c* are a plan view, a side view and a fragment of another modification of the inventive element.
Figure 14B:
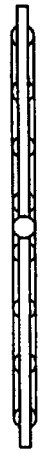
Figure 14C:
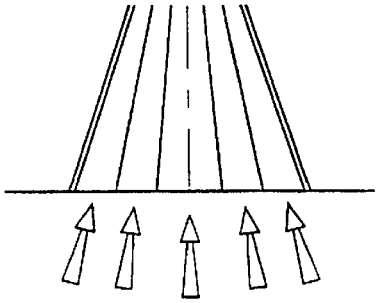

The heat exchanging element shown in FIGS. 14*a*–14*c* is designed substantially similarly, but is based on solid coil-panels which are formed as hollow, stamped elements and then welded metal sheets. Each heat exchanging element has a plurality of tubular channels identified with 141 connected with one another by a metal sheet support. The channels 141 communicate with one another and ultimately with an inlet tube 143 and an outlet tube 144.

Figure 15A:
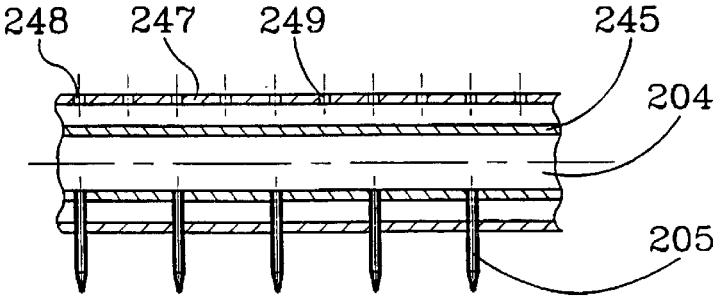
FIGS. 15*a* and 15*b* are an end view and a side view of a distribution line with nozzles for discharging liquid carbon dioxide, provided with the inventive element.
Figure 15B:
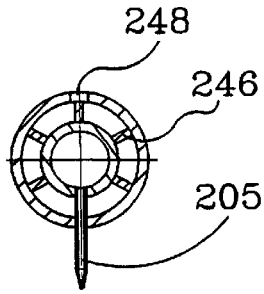

FIG. 15 shows a distribution part of the liquid carbon dioxide supply line 104. It has an internal tube 145 through which liquid carbon dioxide flows. The interior of the internal tube 145 communicates with the interior of the relative nozzles 105. The internal tube 145 is provided with a plurality of longitudinal fins 146 which simultaneously form spacers. The internal tube 145 with the fins 146 is surrounded by external tube 147. The external tube 147 is provided with a plurality of perforations 148. During the operation liquid carbon dioxide is supplied through the interior of the internal tube 145 and is throttled through the nozzles 105 into the interior of the container, it undergoes conversion, dry ice precipitates in the container, while carbon dioxide vapors pass through the perforations 148 into a low pressure passage 149 formed between the interior tube 145 and the exterior tube 147.

Figure 16:
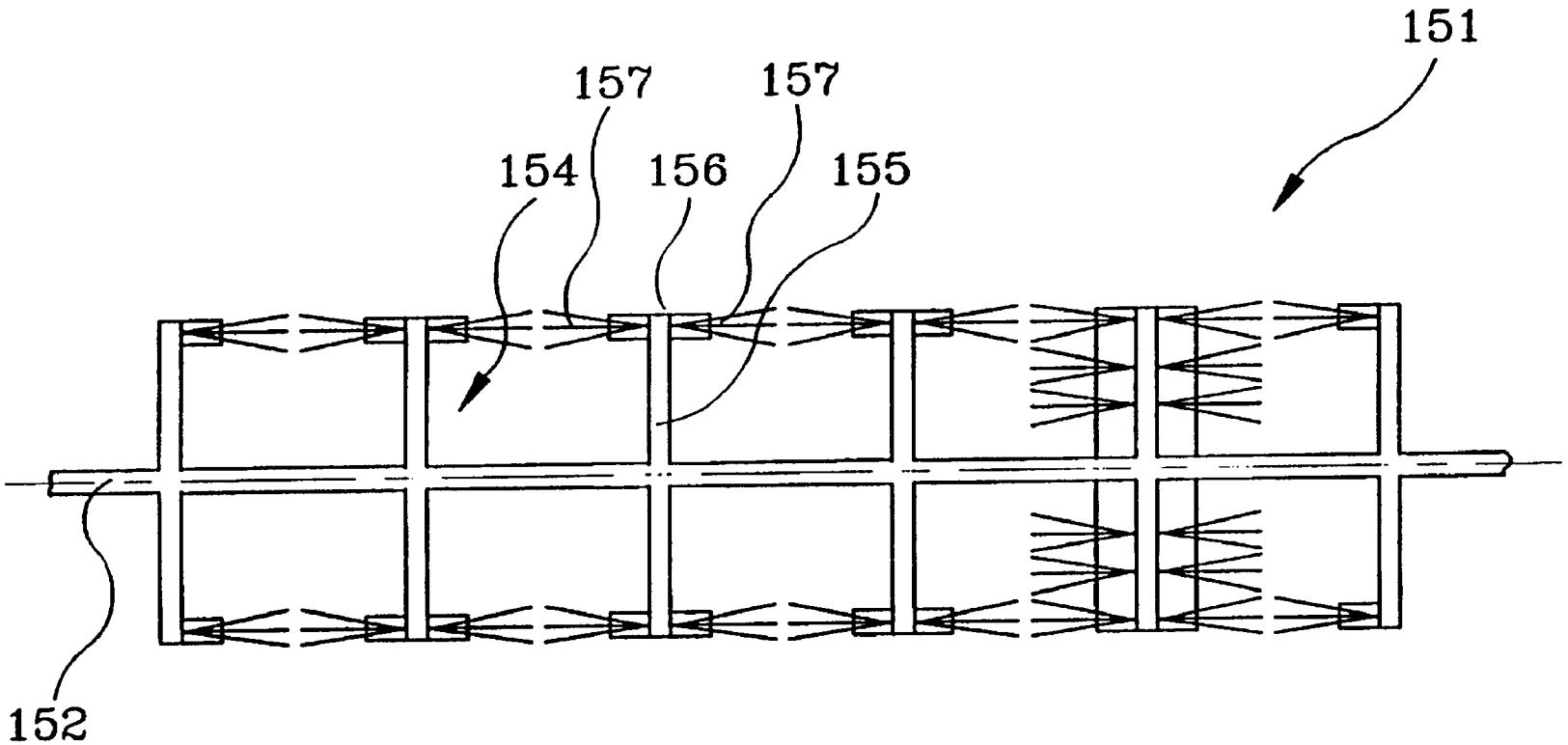
FIG. 16 is a view showing a further apparatus for cooling food products.

An apparatus shown in FIG. 16 is used for cooling food products stored in a container which is identified as a whole with reference numeral 151 and for charging of the container with cold accumulated refrigerant (solid carbon dioxide). The apparatus includes a supply pipe 152 having one end connected with a not shown tank which accommodates liquid carbon dioxide. The supply pipe 152 extends into the interior of the container 151 and is connected with a distributor pipe 153. A plurality of nozzles 154 are mounted on the distributor pipe 153 at opposite sides of a longitudinal axis of the distributor pipe.

Each nozzle 154 has a first inlet tubular portion 155 which communicates with the interior of the distributor pipe 153. Each nozzle further has a second tubular outlet portion 156 which communicates with the interior of the first tubular portion 155 and is provided with two open ends 157. As can be seen from the drawings, one group of the nozzles 154 is located at one longitudinal side of the distributor pipe 153, while the other group of the nozzles 154 is located on the other side of the longitudinal axis of the distributor pipe 153. The inlet portions 155 of the nozzle 154 extend substantially perpendicular to the distributor pipe 153, while the outlet portion 156 of the nozzle 154 extends substantially parallel to the distributor pipe 153.

As can be seen from the drawings, the outlet ends 157 of two neighboring nozzles 154 are arranged so that they face one another. Therefore the jets of liquid carbon dioxide ejected from two neighboring nozzles 154 are directed substantially parallel to the distributor pipe 153 and toward one another so as to collide substantially between the two neighboring nozzles 154. Thereby carbon dioxide snow is produced and distributed over a food product stored in the container 151.

When the apparatus is designed in accordance with the present invention with the nozzles arranged as shown in the drawings, it provides for highly advantageous results. The apparatus is less material consuming since the number of pipes is reduced. It concentrates cold in the areas where it is actually needed for cooling the food products.

Figure 17:
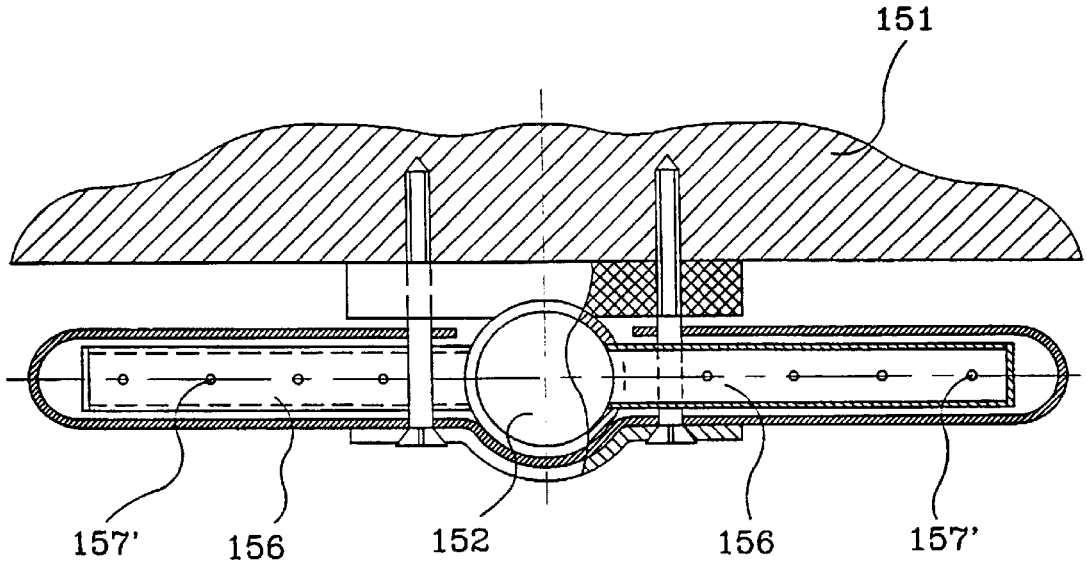
FIG. 17 is a view showing a modification of the apparatus of FIG. 16.

In accordance with further embodiments it is possible to provide in each end of the nozzles several discharge openings 157 as shown in FIG. 17. The outlet portions of the nozzles must not extend parallel to the distributor pipe, but can be inclined at certain angles relative to it.

Figure 18:
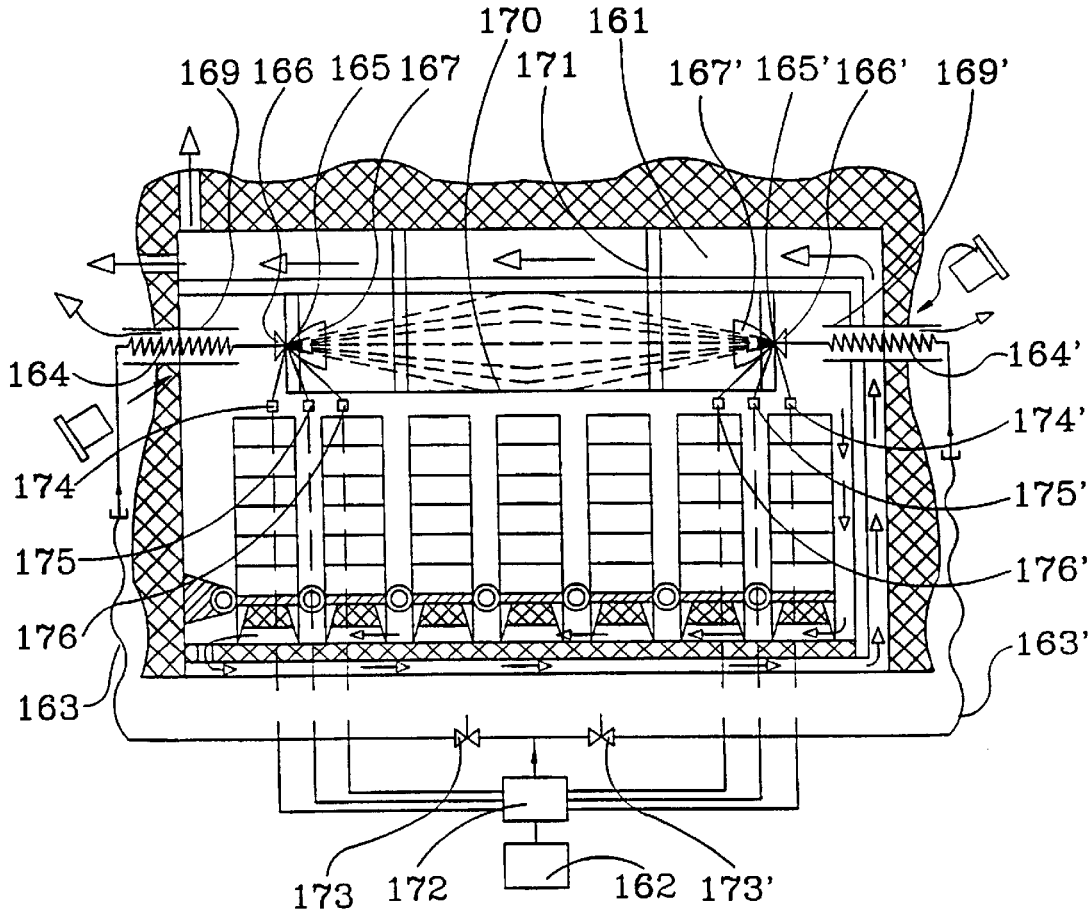
FIG. 18 is a view showing still a further approach for cooling food products.

An apparatus shown in FIG. 18 is used for cooling food products accommodated in a container 161 and for uniform distribution of dry ice during the charging of the container. The apparatus has a tank 162 with liquid carbon dioxide which is supplied through lines 163 and 163' and inner pipes 146 and 164' to two nozzles 165 and 165'. The nozzles are associated with guide cones 166 and horns 167. Outer pipes 9 and 169' surround inner pipes 164 and 164' and extend through corresponding openings in the walls of the container 161. A tray 170 is mounted by supports 171 on the ceiling of the container.

During the operation of the apparatus, carbon dioxide is supplied through the lines 163, 163' and inner pipes 164 and 164' to the nozzles and discharged through the nozzles 165 and 165' by jets directed toward one another. As a result, carbon dioxide snow is produced for cooling the food products accommodated in the container so as to refrigerate the food products. Carbon dioxide vapors produced during this process move through a space between the outer tubes 169, 169' and inner tubes 164 and 164' and give its cold to liquid carbon dioxide supplied through the inner tubes 164, 164'. Then the carbon dioxide vapors are returned in liquefied state to the tank 162.

In accordance with the present invention, means are provided for adjusting a distribution of carbon dioxide snow in the interior of the container relative to the food product. The adjusting means include a control device which is identified as a whole with reference numeral 172. In accordance with one embodiment, the control device 172 is connected with adjustable valves 173 and 173' provided in the lines 163 and 163'. In this construction the control device 172 adjusts the supply of liquid carbon dioxide to the nozzles 165 and 165. In particular, the supply of the liquid carbon dioxide to one nozzle can be different from the supply of liquid carbon dioxide to the other nozzle. This can be achieved by changing the cross-section of a corresponding passages in the valve 173 and 173'. It is advisable to adjust the supplies so that one of the nozzles discharges the maximum quantity of carbon dioxide. At the same time the total supply of carbon dioxide through both nozzles can be constant. In this situation a point of colliding of the two jets of carbon dioxide is offset toward the nozzle which has a lower jet speed, maximum precipitation of carbon dioxide snow is provided in this area.

In accordance with another embodiment of the present invention, the control device 172 provides signals to the nozzles 165 and 165' through signal lines 174 and 174' so as to change a through flow cross-section of the nozzles and therefore a cross-section of carbon dioxide jets discharged from the nozzles with corresponding change of their kinetic energies. The mass flow of the carbon dioxide remains the same, and at the same time, similarly to the first embodiment, the colliding point is displaced toward the nozzle with lower jet speed.

In accordance with still another embodiment of the present invention, the control device 172 is connected with executing devices 175 and 175' with oscillate the nozzles 165 and 165' in a horizontal plane. The discharge flow and speed can be the same for both nozzles. In this embodiment the colliding point oscillates over the food product and uniformly covers its surface.

In accordance with still another feature of the present invention the control device 172 is connected with executing devices 176 and 176' which activate corresponding parts of the nozzles 165 and 165' so that the nozzles impart oscillation to liquid carbon dioxide jets in direction of movement. In other words, the jets are subdivided into portions of higher and lower density and higher and lower specific kinetic energy. It also provides adjustment of the jets and therefore uniform distribution of carbon dioxide snow over the surface of the food products.

Also, it is possible to connected the control device 162 with the executing devices which provide rotatable oscillation of the nozzles around a vertical axis.

Figure 19A:
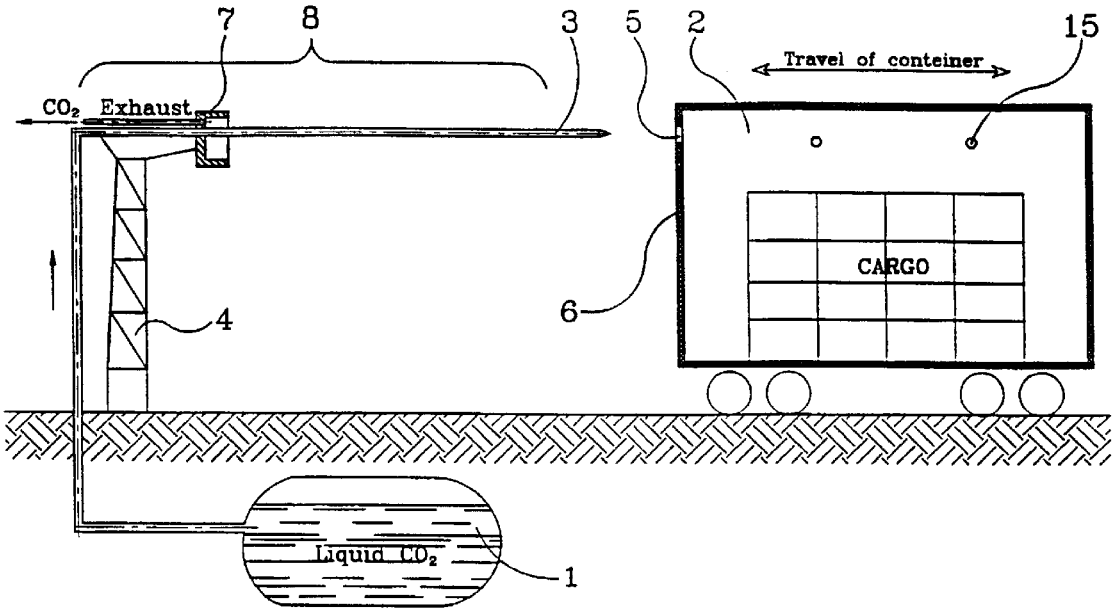
FIGS. 19*a* and 19*b* are a plain view, a side view showing main positions of the equipment at the charging terminal with stationary dispenser and moving container, 19*a*—split units before coupling, 19*b*—coupling and charging.
Figure 19B:
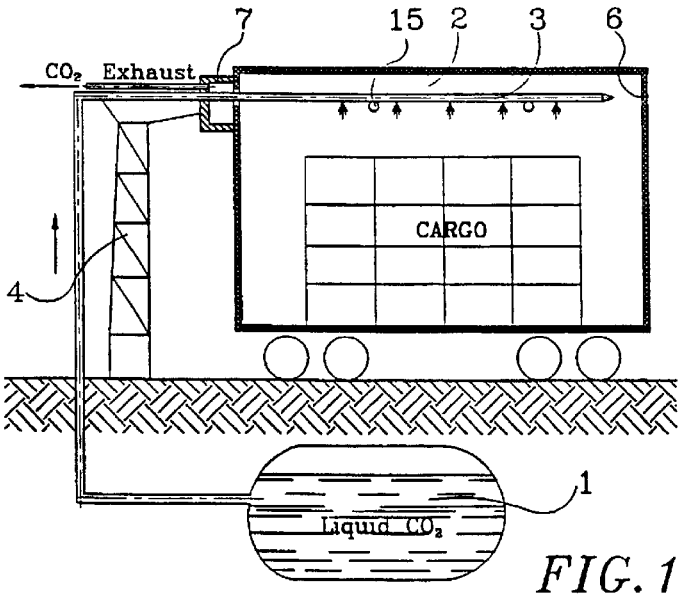

The apparatus, shown in figure FIGS. 19*a* and 19*b* is for supplying liquid carbon dioxide from external tank, 1 into movable container, 2 through the static stationary charger—dispenser, 3 horizontal console bar of the charger—dispenser 3 is installed on the stand 4 at the level of the opening of the wall 6 of the container 2. The withdrawing means for removing the exhaust vapor during the charging duct 7 is also installed on the stand, 4. Charging unit 8 combines unit dispenser 3, withdraw duct 7, and stand 4. Container 2 and charging unit 8 are split apart before the charging process ( see FIG. 19*a*.). The charging unit 8 is maintained on the way of the container 2 or rail car. For charging container 2 is moving onto the charger 8. Dispenser 3 inserts into the opening 5 and with withdrawing means 7 provide docking, coupling to the container and seal of the temporary junction container—charger, as shown in FIG. 19*b*. After these operations a supply of liquid CO2 and charging itself will start.

Figure 20A:
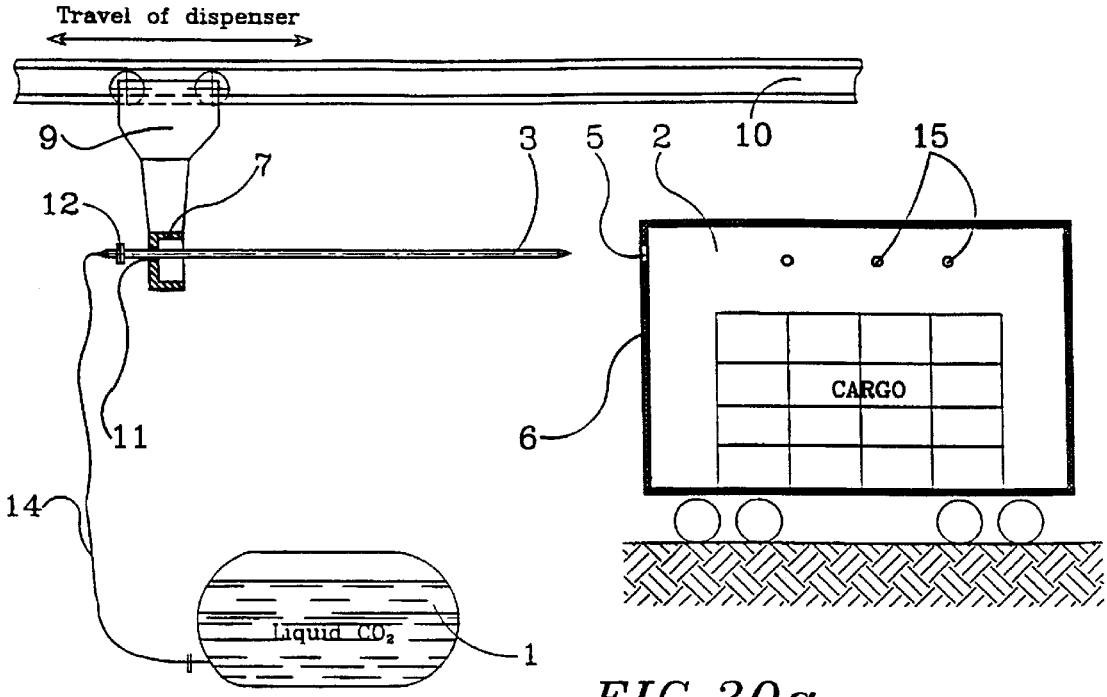
FIGS. 20*a*, and 20*b* are two main positions of the equipment for suspended variant of movable supplying means with stationary container, with 20*a*—split before the coupling, and 20*b*—during the coupling and charging.
Figure 20B:
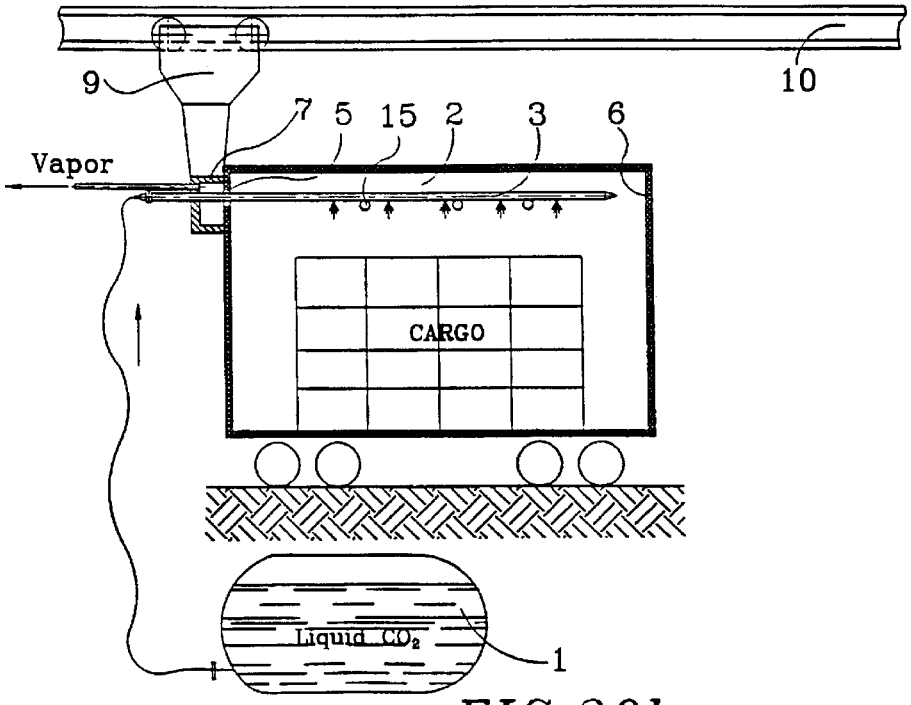

Apparatus shown in FIGS. 20*a* and 20*b* is for supplying of liquid carbon dioxide for external tank 1 into stationary container 2. Dispenser 3 of the external charging unit 8 is active, movable. Dispenser 3 is installed on movable wheel rail truck 9. Rails 10 are installed on the upper level of the container 2 to bring the horizontal charger-dispenser 3 and to insert it through the opening 5 into the internal space of the container 2 and to provide coupling of the means withdrawing exhaust vapor with the container 7 through the opening 5. The tubular horizontal console bar-dispenser (liquid carbon dioxide supplying means) passes through the rear wall of the duct 7 (withdrawing means) through the seal 11, preventing leakage of the vapor into atmosphere. Limit of travel distance of the dispenser 3 inside the container 2 is equal to the internal end 12 of the dispenser 3 is connected to storage of liquid CO2, through system of pipes 13 and flexible hose 14. Rolls 15 installed under the ceiling of the container 2 provide support of the long console bar of the dispenser 3 in horizontal position with minimum deflection during the charging.

Figure 21A:
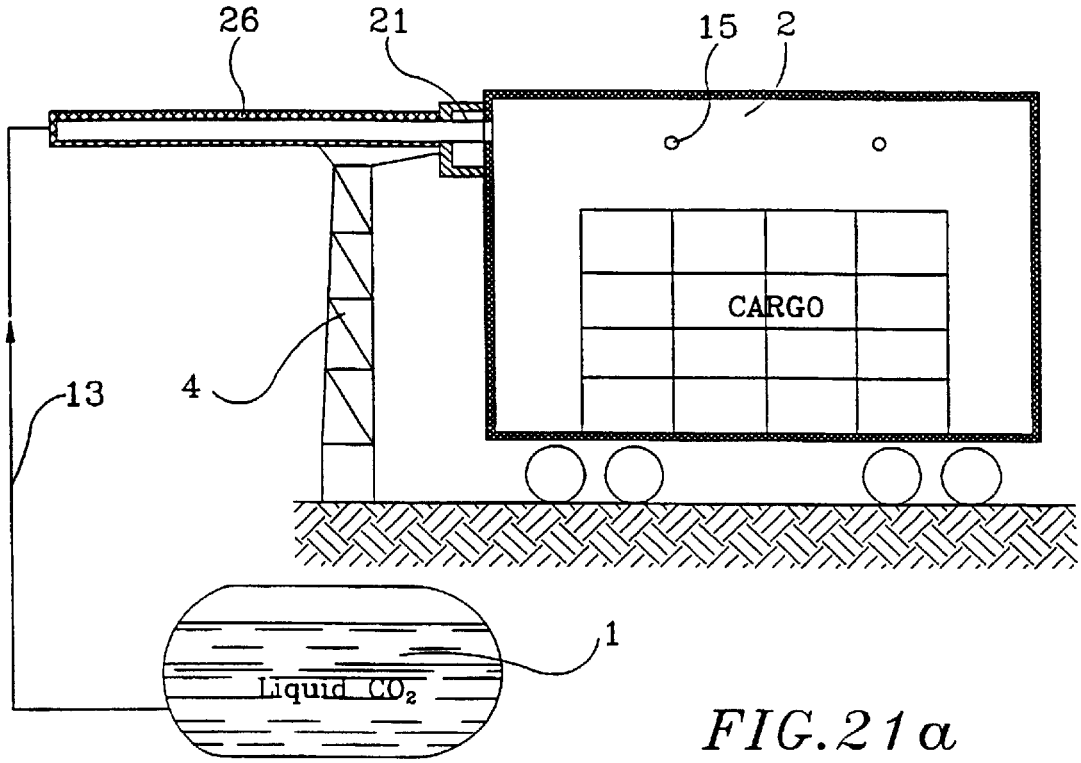
FIGS. 21*a*, 21*b* and 21*c* are views showing charging with retractable telescopic bar-dispenser, with FIG. 21*a*—split unit, FIG. 21*b*—coupling for charging, FIG. 21*c*—design of retractable telescopic bar—dispenser.
Figure 21B:
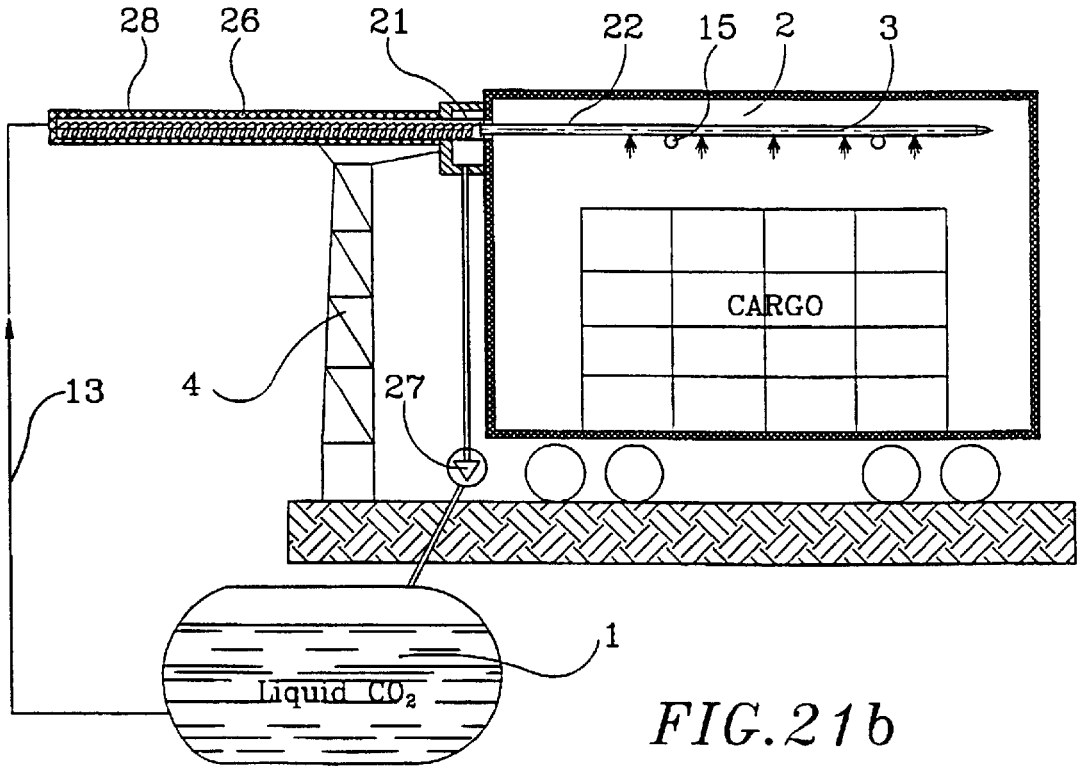
Figure 21C:
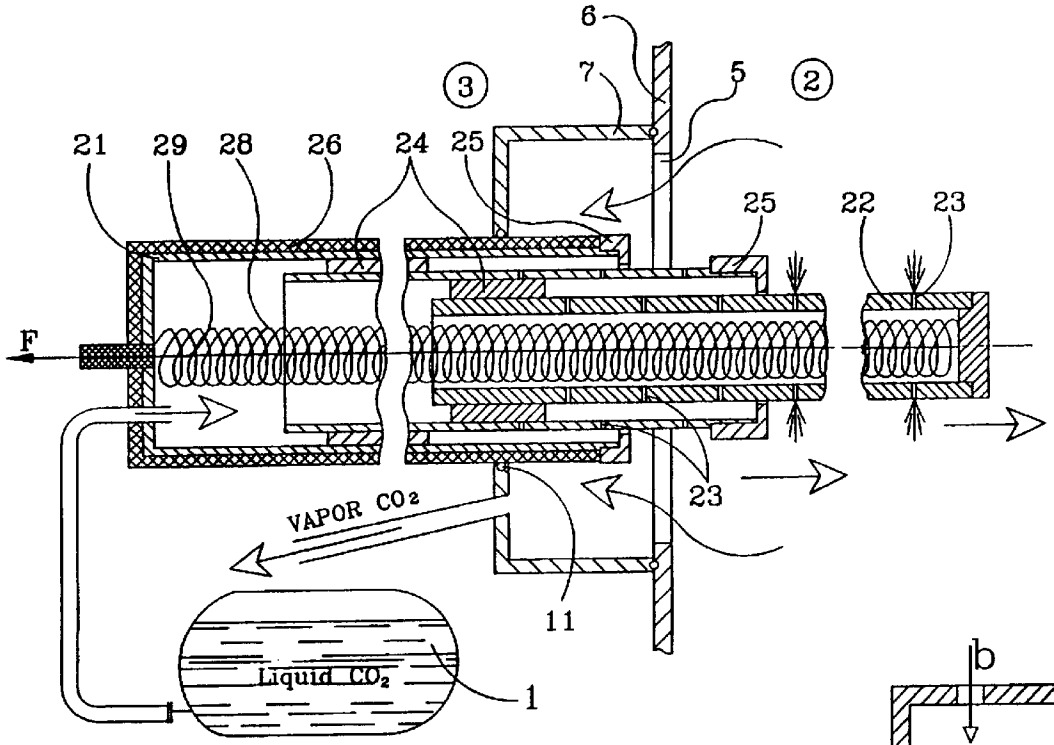

FIGS. 21*a*, 21*b* and 21*c* show another embodiment of charging terminals with movable telescopic dispenser-bar. This system combines advantages of both described before systems with stationary container 2 (FIGS. 20*a* and 20*b*) and with stationary dispenser 3 (FIGS. 19*a*, 19*b*). External tubular part 21 is a casing of the dispenser 3, stationary installed with another major part of the charging unit—withdrawing duct, 7. These parts are maintained on special supporting basis stand 4. In FIG. 21*c* internal tubular part 22 installed inside the external casing 21 has are installed between the surfaces of the tubular parts 22 and 23 of the telescopic bar-dispenser to provide the best relative sliding between the surfaces of the tubular parts of telescopic bar for extending and for retracting to compact start position of the bar. Collar bushes 25 are installed on the ends' of the parts of the telescopic bar-dispenser to provide limitations of the travel during the extending of dispenser. During extending internal sliding bushes 24 rest against the collar bushes 25 and provide durable and rigid structure of telescopic bar-dispenser 3. The external tubular body 21 of the dispenser 3 is supplied with heat insulation 26 and is connected to the external supplier of liquid CO2. After the coupling between the withdrawing mean—duct 7 and container 2 internal tubular parts 22 extend into the internal space of container 2 under internal pressure of the supplied liquid CO2 (pressure inside the dispenser' is 1–3 MPa). Internal tubing elements 22 work like pistons, and power of pressure provides extending of the telescopic dispenser 3. Axial pressure force is equal to 100–500 kg.

After the docking, coupling and extending of dispenser 3 into the internal space of the container 2, liquid CO2 passes from tank 1 through the supplying line 13 through the external tubular part 21 to the internal tubes 22 of the dispenser 3, further through the hole 23, in the walls of the dispenser 3, into the internal space of the container 2. Exhaust CO2 vapor evacuate through the withdrawing duct 7 to the liquefaction unit 27. After the charging all the operations passing in the reverse sequence; retract of the dispenser 3, uncoupling, split and removing of the container 2, and charging unit 8. Retractable dispenser can contain one or few internal movable tubular parts 23. Design with one movable part 23 is the most simple, but requires large working areas for installation and operations. Design with few movable telescopic tubular parts gives possibility to make the retracted dispenser more compact. Reduction of the length of the external tubular body also reduces heating from surroundings, but design of the dispenser is more complicated. Extending of the dispenser can be provided mainly by means of internal pressure of liquid CO2. Retracting can be provided by means of extended springs 28 inserted inside the tubular space of the telescopic canal of the dispenser 3 or by mechanical drawing links with additional moto-operated drive outside the container. The described means provide quick and easy cooling of container and charging with solid CO2 and can be utilized for other types of refrigerants, for example, for liquid nitrogen.

Figure 22:
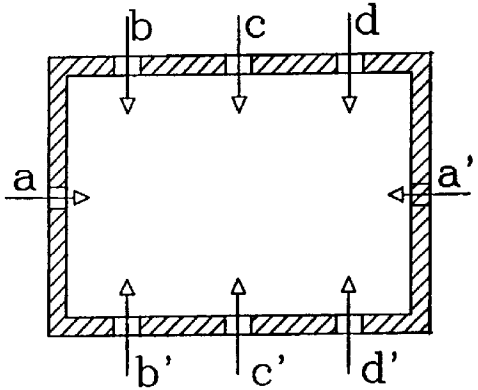
FIG. 22—shows variants of places for docking and coupling of the chargers on a plain view.

FIG. 22 shows variants of installation of external means for charging of containers a,b—location at the ends of the container, inserting and travel of dispensers along the containers; b,c,d—locations at the sides of the containers, inserting of dispensers across the container. Selecting of a scheme can be adjusted to various circumstances: dimensions of container, weight and distribution of solid carbon dioxide in the container, desirable optimum rate of charging, etc.

It is to be understood that the above specified several embodiments can be combined, so that the adjustment of the distribution of the carbon dioxide snow can be provided by two or more solutions or embodiments.

It will be understood that each of the elements described above, or two or more together, may also find a useful application in other types of methods and constructions differing from the types described above.

While the invention has been illustrated and described as embodied in a method of and apparatus for cooling for products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent I set forth in the appended claims.

What is claimed is:

1. An apparatus for cooling food products in a container having an opening, the apparatus comprising means for supplying liquid carbon dioxide in the interior of the container so as to form carbon dioxide snow in the container with simultaneous generation of carbon dioxide vapors; means for withdrawing the carbon dioxide vapors in the vicinity of said supplying means so that cold from the withdrawn carbon dioxide vapors is transmitted to liquid carbon dioxide supplied by said supplying means, said supplying and withdrawing means being movable between an inoperative position in which said supplying and withdrawing means are located outside the opening of the container and outside of the container and an operative position in which said supplying and withdrawing means are arranged inserted in the opening of the container; and sealing means arranged so that when said supplying and withdrawing means have reached said operative position, said sealing means provide self-sealing of the opening of the container.

2. An apparatus as defined in claim 1; and further comprising means for connection of said supplying means and said withdrawing means to the container so as to provide supplying of liquid carbon dioxide through said supplying means into the container and withdrawal of carbon dioxide vapors form the container into and through the said withdrawing means.

3. An apparatus as defined in claim 1, wherein said supplying means is displaceable relative to the container so as to adjust a position of a discharge point of liquid carbon dioxide from said supplying means in the container and therefore to adjust distribution of carbon dioxide snow in the interior of the container.

4. An apparatus as defined in claim 1; and further comprising means for moving said supplying means relative to the container and including a frame supporting said supplying means and provided with a plurality of wheels.

5. An apparatus as defined in claim 1; and further comprising liquid dioxide discharging means located inside the container, said liquid dioxide supplying means being releasably connectable with said liquid carbon dioxide discharging means.

6. An apparatus as defined in claim 1; and further comprising means for mounting said supplying means on the container releasably and pivotally around a horizontal axis so as to provide a tight abutment of said supplying means against the container.

7. An apparatus as defined in claim 1, wherein said supplying means are located inside said withdrawing means, said sealing means being arranged on said withdrawing means.

8. An apparatus as defined in claim 1, wherein supplying means and said withdrawing means are both insertable into the interior of the container through the opening of the container.

9. An apparatus as defined in claim 1, wherein said supplying means are arranged inside said withdrawing means and are longer than said withdrawing means, so that in said operative position said supplying means extend into the interior of the container while said withdrawing means is located outside of the container in the region of the opening container.

10. An apparatus as defined in claim 1; and further comprising means for moving carbon dioxide vapors in the vicinity of said supplying in said container so that cold of carbon dioxide vapors is transferred to the supplied liquid carbon dioxide in said container.

11. An apparatus as defined in claim 10; and further comprising means for withdrawing carbon dioxide vapors from the container, liquefying the withdrawn carbon dioxide vapors and introducing the liquefied carbon dioxide vapor into said supplying means of liquid carbon dioxide.

12. An apparatus as defined in claim 10, wherein said supplying means include a source of liquid carbon dioxide, and an exterior supply line extending from said source to said container, said moving means being arranged so that carbon dioxide vapors move near said exterior supply line so as to transfer cold of carbon dioxide vapors to liquid carbon dioxide in said exterior supply line.

13. An apparatus as defined in claim 10, wherein said container has an inlet opening through which said supply means introduce liquid carbon dioxide into the interior of the container, said moving means being formed so that carbon dioxide vapors move in the said inlet opening so that cold of carbon dioxide vapors is transferred to liquid carbon dioxide in said inlet opening of said container.

14. An apparatus as defined in claim 10, wherein said container has a plurality of walls, said supplying means being formed so that liquid carbon dioxide is moved in the vicinity of at least one of said walls, said moving means being formed so that carbon dioxide vapors move in the vicinity of said at least one wall so that cold of carbon dioxide vapors is transferred to liquid carbon dioxide in the vicinity of said at least one wall.

15. An apparatus as defined in claim 10, wherein said container has a floor including a plurality of floor elements which are spaced from one another and provided with channels, said supplying means being arranged sot hat liquid carbon dioxide is supplied through said channels of said floor elements, said moving means being formed so that carbon dioxide vapors move between said floor elements so that cold of carbon dioxide is transferred to liquid carbon dioxide through said floor elements.

16. An apparatus as defined in claim 10, wherein said supplying means include a plurality of pipes which form panels arranged so that said panels are spaced from one another by smaller distances at one end and are spaced from one another by greater distances at another end and liquid carbon dioxide flows from said one end to said another end.

17. An apparatus as defined in claim 17 wherein said supplying means include tubular means for supplying liquid carbon dioxide snow from carbon dioxide vapors during movement of carbon dioxide vapors and further sublimating the separated carbon dioxide snow.

18. An apparatus as defined in claim 17, wherein said supplying means include tubular means for supplying liquid carbon dioxide inside said tubular means, said separating means include net-like means arranged on said tubular means and formed so that carbon dioxide vapors can pass through said net-like means while carbon dioxide snow is retained by said net-like means and be submitted by the supplied liquid carbon dioxide.

19. An apparatus as defined in claim 1, wherein said supplying means include a tubular pipe adapted to extend in an interior of the container so as to supply liquid carbon dioxide; and a plurality of nozzles arranged on said distributor pipe to discharge the liquid carbon dioxide from the distributor pipe, said nozzles being arranged so that jets of liquid carbon dioxide ejected by said nozzles extend substantially along a longitudinal axis of said distributor pipe and toward one another to collie substantially between said nozzles, each of said nozzles having a first inlet portion arranged substantially perpendicular to said distributor pipe and communicating with an interior of said distributor pipe, and second outlet portion communicating with an interior of said first portion and extending substantially parallel to said distributor pipe, said outlet portion having two open ends spaces from one another in a longitudinal direction of said longitudinal pipes.

20. An apparatus as defined in claim 19, wherein said nozzles include one group of nozzles located on one of side of a longitudinal axis of said distributor pipe and another group of nozzles arranged at another side of said longitudinal axis of said distributor pipe.

21. An arrangement as defined in claim 19, wherein each of said nozzles has a first inlet portion arranged substantially perpendicular to said distributor pipe and communicating with an interior of said distributor pipe, and second outlet portion communicating with an interior of said first portion and extending substantially parallel to said distributor pipe, said outlet portion having two open ends spaced from one another in a longitudinal direction of said longitudinal pipes.

22. An apparatus as defined in claim 1; and further comprising at least two nozzles connected with said supplying means and discharging liquid carbon dioxide in two jets directed toward and collide with one another so as to produce carbon dioxide snow; and means for adjusting the jets of said nozzles so as to displace a point of colliding the jets with one another and to thereby to provide a uniform distribution of carbon dioxide snow in the container.

23. An apparatus as defined in claim 22, wherein said adjusting means include means for changing a supply liquid through one of said nozzles so that a greater discharge of liquid carbon dioxide is provided, while through the other of said nozzles a smaller discharge of li9quid carbon dioxide is provided.

24. An apparatus as defined in claim 22, wherein said adjusting means include means for changing a throughflow cross-section of said nozzles so as to dispense the point of colliding of the jets discharged from said nozzles toward one of said nozzles having reduced speed and kinetic energy of the jet.

25. An apparatus as defined in claim 22, wherein said adjusting means include means for rotatably oscillating said nozzles about a vertical axis.

26. An apparatus as defined in claim 22, wherein said adjusting means include means for discharging the jets from said nozzles with alternating frequencies.

27. An apparatus as defined in claim 22, wherein said adjusting means include means for oscillating said nozzles in a horizontal plane.

28. An apparatus as defined in claim 22, wherein said adjusting means include with which said nozzles impart to the jets oscillation in a direction of movement of the jets.

29. An apparatus as defined in claim 1; and further comprising means for docking said supplying means relative to the container and coupling said means to the container and including a suspension carrying said means with possibility of movement and coupling with the container.

30. An apparatus as defined in claim 1; and further comprising means for docking said supplying means relative to the container and including a suspension carriage, said carriage is a wheel truck installed at an upper level of the container with possibilities of moving the supplying means in direction of the container, coupling a charger to the opening of the container, docking, coupling, sealing and locking of the charger to the container and after finishing the charging further in a reverse sequence split, unlocking, unsealing and removing of the supplying means from the container.

31. An apparatus as defined in claim 1, wherein said supplying means include longitudinal tubing means with discharging openings, and connected to storage of the cooling cryogen products.

32. An apparatus as defined in claim 1, wherein supplying means are installed motionless, and the container can move relatively said supplying means for docking, coupling of said supplying means and container for charging and to provide uniform distribution of solid carbon dioxide.

33. An apparatus as defined in claim 1, wherein the container is installed motionless and the supplying means have possibility of reciprocation for charging.

34. An apparatus as defined in claim 1, wherein dispenser is a telescopic tubing bar extending during charging and telescopically retracting after the charging.

35. An apparatus as defined in claim 34 wherein an external tubular part of telescopic dispenser is a pressure cylinder, connected to a source of high pressure liquid CO2, internal tubular parts are sequential pistons, communicated with internal volume of container, said moving parts are connected by extend spring or by link with a mechanical drive for retracting the dispenser between charging modes.

36. A method of cooling food products in a container having an opening, the method comprising the steps of supplying liquid carbon dioxide in the interior of the container so as to form carbon dioxide snow in the container with simultaneous generation of carbon dioxide vapors; withdrawing the carbon dioxide vapors from the container and moving the withdrawn carbon dioxide vapors in the vicinity of said supplying means so that cold from the withdrawn carbon dioxide vapors is transmitted to liquid carbon dioxide supplied by the supplying means; moving supplying and withdrawing means between an inoperative position in which they are located outside the opening of the container and outside of the container and an operative position in which they are arranged inserted in the opening of the container; and sealing the opening of the container when the supplying and withdrawing have reached the operative position.

37. A method as defined in claim 29; and further comprising the steps of discharging liquid carbon dioxide in the interior of the container by at least two nozzles which are arranged so that jets of liquid carbon dioxide discharge from the nozzles are directed toward and collide with one another; and periodically adjusting the jets relative to one another so as to displace a point of colliding the jets with one another and to thereby provide a substantial uniform distribution of carbon dioxide snow in the container.

* * * * *